US007104077B2

(12) United States Patent
Yabu et al.

(10) Patent No.: US 7,104,077 B2
(45) Date of Patent: Sep. 12, 2006

(54) AIR CONDITIONING APPARATUS

(75) Inventors: Tomohiro Yabu, Sakai (JP); Yoshimasa Kikuchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 178 days.

(21) Appl. No.: 10/493,878

(22) PCT Filed: Sep. 12, 2002

(86) PCT No.: PCT/JP02/09382

§ 371 (c)(1),
(2), (4) Date: Apr. 28, 2004

(87) PCT Pub. No.: WO03/040629

PCT Pub. Date: May 15, 2003

(65) Prior Publication Data

US 2004/0250557 A1 Dec. 16, 2004

(30) Foreign Application Priority Data

Nov. 9, 2001 (JP) ..... 2001-344057

(51) Int. Cl.
*F25D 17/06* (2006.01)

(52) U.S. Cl. ..... 62/94; 62/271

(58) Field of Classification Search ..... 62/93, 62/94, 271

See application file for complete search history.

(56) References Cited

U.S. PATENT DOCUMENTS 4,729,774 A * 3/1988 Cohen et al. ..... 96/123
5,649,428 A * 7/1997 Calton et al. ..... 62/94

FOREIGN PATENT DOCUMENTS

| | | | |
|---|---|---|---|
| EP | 1408286 | A1 | 4/2004 |
| EP | 1408287 | A1 | 4/2004 |
| JP | 51-078048 | A | 7/1976 |
| JP | 55-39434 | U | 3/1980 |
| JP | 56-132471 | U | 10/1981 |
| JP | 62-068520 | A | 3/1987 |
| JP | 06-147546 | A | 5/1994 |
| JP | 8-313186 | A | 11/1996 |
| JP | 9-318127 | A | 12/1997 |
| JP | 2001-263729 | A | 9/2001 |
| JP | 2001-263764 | A | 9/2001 |
| WO | WO-03/038344 | A1 | 5/2003 |
| WO | WO-03/038345 | A | 5/2003 |

* cited by examiner

*Primary Examiner*—Melvin Jones
(74) *Attorney, Agent, or Firm*—Global IP Counselors

(57) ABSTRACT

An air conditioning apparatus is provided with an adsorption element having a humidity adjusting side passageway configured to adsorb and desorb moisture by passage of adsorption air or regeneration air and a cooling side passageway through which cooling air passes so that the adsorption air is cooled by absorption of heat of adsorption generated during the adsorption in the humidity adjusting side passageway. In the air conditioning apparatus, air is humidified or dehumidified in the humidity adjusting side passageway of the adsorption element and is supplied to an indoor space. In order to achieve improvements in the cooling efficiency when cooling adsorption air by the use of cooling air in the cooling side passageway, room air, conditioned air, or mixed air which is a combination of room air and outdoor air is used as cooling air which is forced to flow through the adsorption element.

20 Claims, 17 Drawing Sheets

DEHUMIDIFICATION OPERATING MODE (FIRST OPERATION)

DEHUMIDIFICATION OPERATING MODE (SECOND OPERATION)

AIR CONDITIONING APPARATUS

TECHNICAL FIELD

The present invention relates to air conditioning apparatuses and more particularly to an air conditioning apparatus of the desiccant type which employs an adsorption element comprising a humidity adjusting side passageway capable of moisture adsorption by passage of adsorption air and moisture desorption by passage of regeneration air and a cooling side passageway through which cooling air passes for absorption of heat of adsorption generated during the adsorption in the humidity adjusting side passageway.

BACKGROUND ART

Air conditioning apparatuses capable of providing so-called desiccant air conditioning have been known in the prior art. Such a desiccant air conditioning apparatus is so configured as to perform air conditioning by controlling the humidity level of air for supply to indoor spaces. The desiccant air conditioning apparatus has constructional equipment including an adsorption element, a heater, a cooler et cetera. The adsorption element performs moisture adsorption/desorption by passage of adsorption air or regeneration air. For example, Japanese Patent Kokai Publication No. (1997)318127 describes an air conditioning apparatus employing two adsorption elements of the above-described type. In this prior art air conditioning apparatus, either a dehumidified air stream or a humidified air stream is continuously supplied to an indoor space by switching between a first state in which moisture contained in adsorption air is adsorbed by one of the adsorption elements simultaneously with regeneration of the other adsorption element by regeneration air and a second state in which one of the adsorption elements is regenerated by regeneration air simultaneously with adsorption of moisture contained in adsorption air by the other adsorption element.

Apart from that, dehumidification of adsorption air by the adsorption element will give rise to generation of heat of adsorption. And, if the adsorption air temperature is raised, this lowers adsorption performance. To deal with this problem, a technical proposal of cooling the adsorption element by the use of cooling air has been made.

Such a type of adsorption element which is made cool by cooling air is provided with a humidity adjusting side passageway through which adsorption air or regeneration air flows and a cooling side passageway through which cooling air flows. And, the cooling side passageway is configured so that heat of adsorption, generated when adsorption air passes through the humidity adjusting side passageway, is absorbed by cooling air.

In the above-described air conditioning apparatus, adsorption air is forced to flow through the humidity adjusting side passageway of the adsorption element so that the adsorption air is dehumidified. Furthermore, the adsorption air thus dehumidified is cooled by a cooler for supply to an indoor space. In this way, a cooling mode of operation is performed. At this time, cooling air flows through the cooling side passageway of the adsorption element, whereby the adsorption air is cooled. Thereafter, the cooling air is discharged outdoors. In addition, when large amounts of moisture are adsorbed on the adsorption element after the operation is carried out for a predetermined period of time, regenerating air, heated to a high temperature by the heater, is forced to flow through the humidity adjusting side passageway. As a result, the adsorption element is regenerated.

In the conventional air conditioning apparatuses, outdoor air serves as cooling air. Because of this, cooling efficiency is low during hot climate conditions such as summer, thereby producing the problem that heat of adsorption in the humidity adjusting side passageway cannot be collected in satisfactory manner. And, in such a case, the adsorption performance of the apparatus finally falls.

Bearing in mind that the conventional air conditioning apparatuses suffer the above-described drawbacks, the present invention was made. Accordingly, an object of the present invention is to provide improved cooling efficiencies in the case where an adsorption element, the temperature of which is raised by heat of adsorption generated when adsorption air flows through a humidity adjusting side passageway, is cooled by the use of cooling air.

DISCLOSURE OF INVENTION

The present invention is an air conditioning apparatus in which room air (RA), conditioned air (CA), or a mixed air (RA+OA) which is a combination of room air (RA) and outdoor air (OA) flows through an adsorption element as cooling air.

More specifically, the present invention implements a first problem solving means which is an air conditioning apparatus, provided with an adsorption element (81, 82, 250) having a humidity adjusting side passageway (85) capable of moisture adsorption by passage of adsorption air and moisture desorption by passage of regeneration air and a cooling side passageway (86) through which cooling air passes for absorption of heat of adsorption generated during the adsorption in the humidity adjusting side passageway (85), for supplying air, the humidity level of which has been adjusted in the humidity adjusting side passageway (85) of the adsorption element (81, 82, 250), to an indoor space.

The air conditioning apparatus according to the first problem solving means is characterized in that the cooling air is composed of room air (RA).

In the first problem solving means, when adsorption air flows through the humidity adjusting side passageway (85) of the adsorption element (81, 82, 250), moisture contained in the adsorption air is adsorbed onto the adsorption element (81, 82, 250). As a result, the adsorption air is dehumidified. At this time, room air (RA) flows, as cooling air, through the cooling side passageway (86) of the adsorption element (81, 82, 250), and heat of adsorption generated in the humidity adjusting side passageway (85) is collected by the cooling air. In other words, if the temperature of adsorption air is raised by heat of adsorption thereby resulting in a decrease in relative humidity, this makes it difficult for water vapor contained in the adsorption air to adsorb onto the adsorption element (81, 82, 250). However, by virtue of the arrangement that heat of adsorption is absorbed by cooling air, the rise in adsorption air temperature can be suppressed, thereby securing an amount of moisture to be adsorbed onto the adsorption element (81, 82, 250). In the adsorption element, the temperature at the outlet side is higher than the temperature at the inlet side, which means that the amount of moisture adsorbable at the outlet side conventionally diminishes. On the contrary, in accordance with the first problem solving means, the temperature gradient from the inlet side to the outlet side becomes small, thereby securing an amount of moisture to be adsorbed.

In addition, since room air (RA) is used as cooling air in the above-described arrangement, this makes it possible to efficiently cool the humidity adjusting side passageway (85) in comparison with the case where outdoor air (OA) is used as cooling air. On the other hand, when the moisture adsorption amount of the humidity adjusting side passageway (85) increases, regeneration air is made to flow through the humidity adjusting side passageway (85) so that moisture present in the humidity adjusting side passageway (85) is discharged to the regeneration air for regeneration of the adsorption element (81, 82, 250).

In addition, the present invention implements a second problem solving means which is an air conditioning apparatus based on the first problem solving means. The air conditioning apparatus of the second problem solving means is characterized in that the cooling air is composed of conditioned air (CA).

In the second problem solving means, by virtue of the use of conditioned air (CA) as cooling air, the adsorption element (81, 82, 250) can be cooled using air lower in temperature than room air (RA). Consequently, it becomes possible to improve cooling performance further.

In addition, the present invention provides a third problem solving means which is an air conditioning apparatus according to the first or second solving means. The air conditioning apparatus of the third problem solving means is characterized in that it comprises a plurality of adsorption elements (81, 82), and is configured so that (i) a first operation in which adsorption by forcing adsorption air to flow through a humidity adjusting side passageway (85) of the first adsorption element (81) is carried out while simultaneously cooling by forcing cooling air to flow through a cooling side passageway (86) of the first adsorption element (81) is carried out and, in addition, regeneration by forcing regeneration air to flow through a humidity adjusting side passageway (85) of the second adsorption element (82) is carried out and (ii) a second operation in which adsorption by forcing adsorption air to flow through the humidity adjusting side passageway (85) of the second adsorption element (82) is carried out while simultaneously cooling by forcing cooling air to flow through a cooling side passageway (86) of the second adsorption element (82) is carried out and, in addition, regeneration by forcing regeneration air to flow through the humidity adjusting side passageway (85) of the first adsorption element (81) is carried out, are executed in alternation.

In the third problem solving means, the air conditioning apparatus is provided with at least two adsorption elements (81, 82) and the first operation and the second operation are carried out in alternation. In the first operation, adsorption and cooling operations for the first adsorption element (81) are carried out while a regeneration operation for the second adsorption element (82) is carried out. On the other hand, in the second operation, contrary to the first operation, adsorption and cooling operations for the second adsorption element (82) are carried out while a regeneration operation for the first adsorption element (81) is carried out. And, the operation, in which either air dehumidified by adsorption or air humidified by regeneration is supplied indoors, is executed continuously.

Furthermore, the present invention provides a fourth problem solving means which is an air conditioning apparatus according to the third problem solving means. The air conditioning apparatus of the fourth problem solving means is characterized in that it is provided with a switching mechanism for switching of flow channels of adsorption air, cooling air, and regeneration air, and is so configured as to switch between the first operation and the second operation by the operation of the switching mechanism and by forcing the adsorption elements (81, 82) to rotate through a predetermined angle.

In the fourth problem solving means, the air conditioning apparatus is provided with a switching mechanism. By virtue of the operation of the switching mechanism, air flow channels in the air conditioning apparatus are switched. In the air conditioning apparatus of the present problem solving means, at the time when switching between the first operation and the second operation is made, the switching mechanism operates and the adsorption elements (81, 82) are rotated for a predetermined angle.

Furthermore, the present invention provides a fifth problem solving means which is an air conditioning apparatus according to the third problem solving means. The air conditioning apparatus of the fifth problem solving means is characterized in that it is provided with a switching mechanism for switching of flow channels of adsorption air, cooling air, and regeneration air, and is so configured as to switch between the first operation and the second operation by execution of the operation of the switching mechanism with the adsorption elements (81, 82) fixed in position.

In the fifth problem solving means, the air conditioning apparatus is provided with a switching mechanism. By virtue of the operation of the switching mechanism, air flow channels in the air conditioning apparatus are switched. In the air conditioning apparatus of the present problem solving means, at the time when switching between the first operation and the second operation is made, the switching mechanism operates. At that time, the adsorption elements (81, 82) are not rotated, in other words they remain stationary.

In addition, the present invention provides a sixth problem solving means which is an air conditioning apparatus according to either the first problem solving means or the second problem solving means. The air conditioning apparatus of the present problem solving means is characterized in that: the adsorption element (250) is shaped like a circular disk; humidity adjusting side passageways (85) pass completely through the adsorption element (250) in the thickness-wise direction thereof while cooling side passageways (86) pass completely through the adsorption element (250) in the radial direction thereof; and while causing the adsorption element (250) to rotate around its central axis, adsorption by introducing adsorption air into a humidity adjusting side passageway (85) which is formed in a portion of the adsorption element (250) is carried out simultaneously with cooling by forcing cooling air to flow through a cooling side passageway (86) in association with the humidity adjusting side passageway (85); and, in addition, regeneration by introducing regeneration air into a humidity adjusting side passageway (85) that is formed in another portion of the adsorption element (250) is carried out. The adsorption element (250) may be rotated continuously or may be rotated intermittently.

In the sixth problem solving means, an adsorption operation by introduction of adsorption air into a humidity adjusting side passageway (85) formed in a portion of the adsorption element (250) is carried out while rotating the adsorption element (250) and, at the same time, a cooling operation by forcing cooling air to flow through a cooling side passageway (86) in association with the humidity adjusting side passageway (85) is carried out, and, in addition, a regeneration operation by introducing regeneration air into a humidity adjusting side passageway (85) formed in another portion of the adsorption element (250) is carried out. Accordingly, adsorption is carried out simultaneously concurrently with regeneration.

The present invention provides a seventh problem solving means which is an air conditioning apparatus according to the third problem solving means. The air conditioning apparatus of the present problem solving means is characterized in that the regeneration air is composed of air as a result of heating of cooling air.

The present invention provides an eighth problem solving means which is an air conditioning apparatus according to the sixth problem solving means. The air conditioning apparatus of the present problem solving means is characterized in that the regeneration air is composed of air as a result of heating of cooling air.

In each of the seventh and eighth problem solving means, the cooling air, which has been heated by absorption of heat of adsorption generated in the humidity adjusting side passageway (85) of the adsorption element (81, 82, 250), is heated further to a higher level and is used as regeneration air for use in regeneration of the adsorption element (81, 82, 250).

Furthermore, the present invention provides a ninth problem solving means which is an air conditioning apparatus similar to the first problem solving means. The air conditioning apparatus of the present problem solving means is characterized in that the cooling air is composed of mixed air (RA+OA) which is a combination of room air (RA) and outdoor air (OA).

In the ninth problem solving means, when adsorption air flows through the humidity adjusting side passageway (85) of the adsorption element (81, 82, 250), moisture contained in the adsorption air is adsorbed onto the adsorption element (81, 82, 250). As a result, the adsorption air is dehumidified. At this time, mixed air (RA+OA) which is a combination of room air (RA) and outdoor air (OA) flows, as cooling air, through the cooling side passageway (86) of the adsorption element (81, 82, 250), and heat of adsorption generated in the humidity adjusting side passageway (85) is collected by the cooling air. In other words, the arrangement that heat of adsorption is absorbed by cooling air suppress the rise in adsorption air temperature and reduces the drop in relative humidity, thereby securing amounts of moisture to be adsorbed onto the adsorption element (81, 82, 250), as in the first and second problem solving means.

Furthermore, the present invention provides a tenth problem solving means which is an air conditioning apparatus according to the ninth problem solving means. The air conditioning apparatus of the present problem solving means is characterized in that it comprises a plurality of adsorption elements (81, 82), and is configured so that (i) a first operation in which adsorption by forcing adsorption air to flow through a humidity adjusting side passageway (85) of the first adsorption element (81) is carried out while simultaneously cooling by forcing cooling air to flow through a cooling side passageway (86) of the first adsorption element (81) is carried out and, in addition, regeneration by forcing regeneration air to flow through a humidity adjusting side passageway (85) of the second adsorption element (82) is carried out and (ii) a second operation in which adsorption by forcing adsorption air to flow through the humidity adjusting side passageway (85) of the second adsorption element (82) is carried out while simultaneously cooling by forcing cooling air to flow through a cooling side passageway (86) of the second adsorption element (82) is carried out and, in addition, regeneration by forcing regeneration air to flow through the humidity adjusting side passageway (85) of the first adsorption element (81) is carried out, are executed in alternation.

Furthermore, the present invention provides an eleventh problem solving means which is an air conditioning apparatus according to the tenth problem solving means. The air conditioning apparatus of the present problem solving means is characterized in that it comprises a switching mechanism for switching of flow channels of adsorption air, cooling air, and regeneration air, and that the air conditioning apparatus is so configured as to switch between the first operation and the second operation by the operation of the switching mechanism and by forcing the adsorption elements (81, 82) to rotate through a predetermined angle.

Furthermore, the present invention provides a twelfth problem solving means which is an air conditioning apparatus according to the tenth problem solving means. The air conditioning apparatus of the present problem solving means is characterized in that it comprises a switching mechanism for switching of flow channels of adsorption air, cooling air, and regeneration air, and that the air conditioning apparatus is so configured as to switch between the first operation and the second operation by execution of the operation of the switching mechanism with the adsorption elements (81, 82) fixed in position.

In each of the tenth to twelfth problem solving means, the air conditioning apparatus is provided with at least two adsorption elements (81, 82) and the first operation and the second operation are carried out in alternation. In the first operation, adsorption and cooling operations for the first adsorption element (81) are carried out while a regeneration operation for the second adsorption element (82) is carried out. On the other hand, in the second operation, contrary to the first operation, adsorption and cooling operations for the second adsorption element (82) are carried out while a regeneration operation for the first adsorption element (81) is carried out. And, the operation, in which either air dehumidified by adsorption or air humidified by regeneration is supplied indoors, is executed continuously.

The concrete running operations of the eleventh and twelfth problem solving means are the same as the fourth and fifth problem solving means.

In addition, the present invention provides a thirteenth problem solving means which is an air conditioning apparatus according to the ninth problem solving means. The air conditioning apparatus of the present problem solving means is characterized in that: the adsorption element (250) is shaped like a circular disk; humidity adjusting side passageways (85) pass completely through the adsorption element (250) in the thickness-wise direction thereof while cooling side passageways (86) pass completely through the adsorption element (250) in the radial direction thereof; while causing the adsorption element (250) to rotate around its central axis, adsorption by introducing adsorption air into a humidity adjusting side passageway (85) which is formed in a portion of the adsorption element (250) is carried out simultaneously with cooling by forcing cooling air to flow through a cooling side passageway (86) in association with the humidity adjusting side passageway (85); and, in addition, regeneration by introducing regeneration air into a humidity adjusting side passageway (85) that is formed in another portion of the adsorption element (250) is carried out.

In the thirteenth problem solving means, an adsorption operation by introduction of adsorption air into a humidity adjusting side passageway (85) formed in a portion of the adsorption element (250) is carried out while rotating the adsorption element (250) and, at the same time, a cooling operation by forcing cooling air to flow through a cooling side passageway (86) in association with the humidity adjusting side passageway (85) is carried out, and, in addition, a regeneration operation by introducing regeneration air into a humidity adjusting side passageway (85) formed in another portion of the adsorption element (250) is carried out. Accordingly, adsorption is carried out simultaneously concurrently with regeneration, as in the sixth problem solving means.

Furthermore, the present invention provides a fourteenth problem solving means which is an air conditioning apparatus according to any one of the ninth to thirteenth problem solving means. The air conditioning apparatus of the present problem solving means is characterized in that the cooling air is composed of a mixture as a result of mixing of room air (RA) and outdoor air (OA) at a predetermined mixing rate according to the temperature of the room air (RA) and the temperature of the outdoor air (OA).

Furthermore, the present invention provides a fifteenth problem solving means which is an air conditioning apparatus according to any one of the ninth to thirteenth problem solving means. The air conditioning apparatus of the present problem solving means is characterized in that the cooling air is composed of a mixture as a result of mixing of room air (RA) and outdoor air (OA) at a predetermined mixing rate according to the temperature of the room air (RA) and the temperature of indoor supply air (SA).

In each of the fourteenth and fifteenth problem solving means, it is possible to make adjustments to the cooling performance by varying the mixing rate at which the room air (RA) and the outdoor air (OA) are mixed together.

Furthermore, the present invention provides a sixteenth problem solving means which is an air conditioning apparatus according to any one of the ninth to thirteenth problem solving means. The air conditioning apparatus of the present problem solving means is characterized in that the cooling air is composed of a mixture as a result of mixing of room air (RA) and outdoor air (OA) at a predetermined mixing rate according to the humidity of the room air (RA) and the humidity of the outdoor air (OA).

For example, in the case where cooling air is heated to serve as regeneration air, cooling ability falls if high-humidity air is used at the regeneration side. However, in accordance with the sixteenth problem solving means, it becomes possible to achieve regeneration by the use of humidity-adjusted air, thereby preventing regeneration ability from dropping to a lower level.

Finally, the present invention provides a seventeenth problem solving means which is an air conditioning apparatus according to either the tenth problem solving means or the thirteenth problem solving means. The air conditioning apparatus of the present problem solving means is characterized in that the regeneration air is composed of air as a result of heating of cooling air.

In the seventeenth problem solving means, the cooling air, which has been heated by absorption of heat of adsorption generated in the humidity adjusting side passageway (85) of the first adsorption element (81), is heated further to a higher level and is introduced, as regeneration air, into the second adsorption element (82) for use in regeneration of the second adsorption element (82).

Effects

In accordance with the first problem solving means, room air (RA) is used as cooling air. As a result of such arrangement, heat of adsorption, generated when adsorption air flows through the humidity adjusting side passageway (85) of the adsorption element (81, 82, 250), is collected efficiently by the cooling air, and cooling efficiency is improved further in comparison with the case where outdoor air (OA) is used as cooling air. Accordingly, adsorption performance is prevented from dropping to a lower level.

For example, when room air (RA) is high in temperature but is low in humidity while outdoor air (OA) is low in temperature but is high in humidity, the amount of adsorption should be increased by gaining cooling effects if only the outdoor air (OA) is used as cooling air. In this case, however, if air as a result of heating of cooling air is used as regeneration air, this causes a drop in the amount of adsorption because the air is humid. In addition, if outdoor air (OA) whose temperature is too low when the climate is extremely cold is used as cooling air, this may result in insufficient regeneration or may cause COP to fall to a lower level because the regeneration temperature has to be raised. Contrary to this, if the room air (RA) is used as cooling air, these problems are eliminated.

In addition, in accordance with the second problem solving means, conditioned air (CA) is used as cooling air, thereby making it possible to cool the adsorption element (81, 82, 250) with air much lower in temperature than room air (RA). Because of such arrangement, cooling performance is enhanced to a further extent, thereby ensuring that the drop in adsorption performance due to the generation of heat of adsorption at adsorption time is avoided.

Furthermore, in accordance with the third to eighth problem solving means, an air conditioning apparatus which uses either room air (RA) or conditioned air (CA) as cooling air to be flowed through the adsorption element (81, 82, 250) is embodied concretely.

In addition, in accordance with the ninth problem-solving means, mixed air (RA+OA) which is a combination of room air (RA) and outdoor air (OA) is used as cooling air, which makes it possible to improve cooling performance to a further extent in comparison with the case where only outdoor air (OA) is used as cooling air.

The tenth to thirteenth problem solving means provide the same effects as do the third to sixth problem solving means.

In addition, the fourteenth and fifteenth problem solving means each make it possible to adjust cooling efficiency by variation in mixing rate of the room air (RA) and the outdoor air (OA). For example, in the case where either one of outdoor air (OA) and room air (RA) is used as cooling air and, in addition, the cooling air is heated so that it serves as regeneration air as in the seventeenth problem solving means, it is possible to increase cooling efficiency if the cooling air temperature is low, but on the other hand such arrangement results in a drop in COP. Contrary to this, if mixed air (RA+OA) as a result of mixing of room air (RA) and outdoor air (OA) is used and the mixing rate thereof is varied, this makes it possible to maintain a balance between the cooling efficiency and the regeneration efficiency. Both the case where the mixing rate is determined based on the difference between the temperature of outdoor air (OA) and the temperature of room air (RA) and the case where the mixing rate is determined based on the difference between the temperature of indoor supply air (SA) and the temperature of room air (RA) provide the same effects. Stated another way, in these problem solving means, the outdoor air (OA) and the indoor supply air (SA) act substantially equivalently.

In the case where cooling air is heated to serve as regeneration air, cooling ability falls if high-humidity air is used at the regeneration side. However, in accordance with the sixteenth problem solving means, it becomes possible to achieve regeneration by the use of humidity-adjusted air, thereby preventing regeneration ability from dropping to a lower level.

BEST MODE FOR CARRYING OUT INVENTION

Embodiment 1

Figure 1:
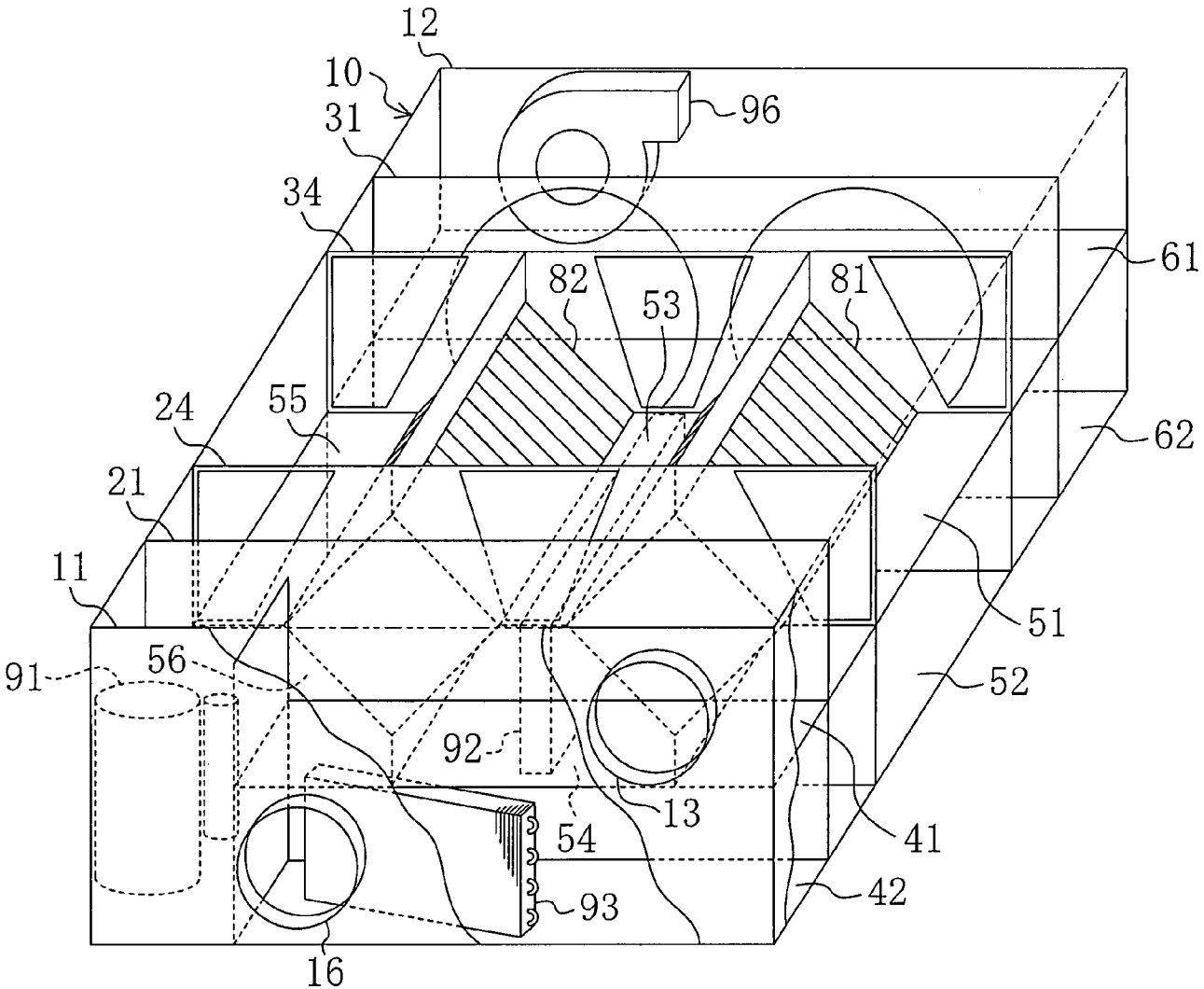
FIG. 1 is a schematic perspective view showing a constructional arrangement of an air conditioning apparatus according to a first embodiment of the present invention.

Hereinafter, a first embodiment of the present invention will be described in detail with reference to the drawing figures. In the description, "upper", "lower", "left", "right", "front", "rear", "front side (near side)", and "rear side (far side)" are used to indicate position. These positional terms should be understood on the basis of the direction of the drawings referred to in the description.

An air conditioning apparatus according to the first embodiment of the present invention is so constructed as to operate switchably between a dehumidification operating mode in which outdoor air (OA) dehumidified and cooled is supplied to an indoor space and a humidification operating mode in which outdoor air (OA) heated and humidified is supplied to an indoor space. Furthermore, the air conditioning apparatus contains two adsorption elements (81, 82), and is constructed so that it performs a so-called batch operation.

In the first place, a constructional arrangement of the air conditioning apparatus of the present embodiment will be described with reference to FIGS. 1–5. The air conditioning apparatus has a somewhat flat, rectangular parallelepiped-shaped casing (10), as shown in FIGS. 1 and 5. The casing (10) houses, in addition to the foregoing two adsorption elements (81, 82), four rotary dampers (71, 72, 73, 74) and a single refrigerant circuit. FIG. 1 omits diagrammatic representation of the rotary dampers (71–74).

Figure 2:
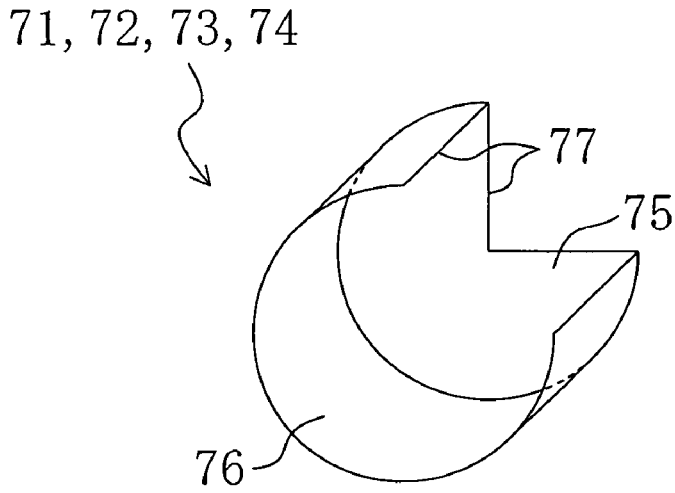
FIG. 2 is a schematic perspective view showing a rotary damper of the air conditioning apparatus according to the first embodiment.

As shown in FIG. 2, the rotary damper (71–74) comprises an end surface portion (75) shaped like a circular disk and a peripheral side portion (76) extending perpendicularly from an outer periphery of the end surface portion (75). The end surface portion (75) is partially notched into a fan shape the central angle of which is 90 degrees. Additionally, a part of the peripheral side portion (76) corresponding to the notched part of the end surface portion (75) is also notched. The notched part of the end surface portion (75) and the notched part of the peripheral side portion (76) form a notched opening (77) of the rotary damper (71–74). Each rotary damper (71–74) is formed rotatably around an axis passing through the center of the end surface portion (75). And, the rotary damper (71–74) constitutes a switching mechanism for switching air flow routes.

Figure 3:
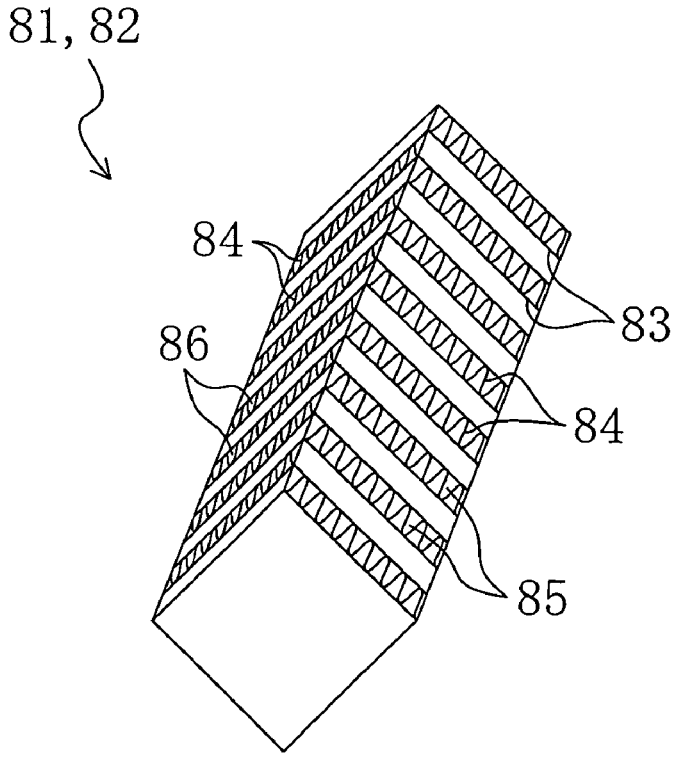
FIG. 3 is a schematic perspective view showing an adsorption element of the air conditioning apparatus according to the first embodiment.

As shown in FIG. 3, each adsorption element (81, 82) comprises alternating laminations of square-shaped flat plate members (83) and corrugated plate members (84). These corrugated plate members (84) are laminated in such orientation that each corrugated plate member (84) is out of alignment in ridgeline direction by an angle of 90 degrees from its neighboring corrugated plate member (84). And, the adsorption element (81, 82) is formed into a square column shape. In other words, each of the end surfaces of the adsorption element (81, 82) is formed into the same square shape as the flat plate member (83).

In the adsorption element (81, 82), humidity adjusting side passageways (85) and cooling side passageways (86) are divisionally formed in alternation in a direction in which the flat plate members (83) and the corrugated plate members (84) are placed one upon the other, facing each other across the respective flat plate members (83). The humidity adjusting side passageway (85) opens in a pair of opposite side surfaces of the adsorption element (81, 82), while the cooling side passageway (86) opens in another pair of opposite side surfaces of the adsorption element (81, 82). Surfaces of the flat plate members (83) that face the humidity adjusting side passageways (85) and surfaces of the corrugated plate members (84) disposed in the humidity adjusting side passageways (85) are coated with an adsorbent capable of water vapor adsorption. As the adsorbent, silica gel, zeolite, ion exchange resin, et cetera may be used. The humidity adjusting side passageway (85) adsorbs moisture by the passage of adsorption air and desorbs moisture by the passage of regeneration air, and cooling air passes through the cooling side passageway so that heat of adsorption generated during the adsorption in the humidity adjusting side passageway (85) is absorbed.

The refrigerant circuit is a closed circuit as a result of piping connection of a compressor (91), a regenerative heat exchanger (92) which operates as a condenser, an expansion valve which operates as an expansion mechanism, a first cooling heat exchanger (93) which operates as an evaporator, and a second cooling heat exchanger (94) which operates as an evaporator. The regenerative heat exchanger (92) constitutes a heater. Diagrammatic representation of the entire arrangement of the refrigerant circuit and the expansion valve is omitted.

The refrigerant circuit is so constructed as to perform a vapor compression refrigeration cycle by circulation of a refrigerant charged therein. Furthermore, the first cooling heat exchanger (93) and the second cooling heat exchanger (94) are connected in parallel in the refrigerant circuit. And, the refrigerant circuit is so constructed as to operate switchably between an operation in which only the first cooling heat exchanger (93) serves as an evaporator with no introduction of refrigerant into the second cooling heat exchanger (94), and an operation in which only the second cooling heat exchanger (94) operates as an evaporator with no introduction of refrigerant into the first cooling heat exchanger (93).

Referring to FIGS. 1 and 5, the casing (10) is provided with an outdoor side panel (11) which is a nearest side situated panel, and an indoor side panel (12) which is a farthest side situated panel. An air supply side inlet (13) is formed in an upper-right corner of the outdoor side panel (11). An air discharge side outlet (16) is formed to the bottom left of the outdoor side panel (11). On the other hand, an air supply side outlet (14) is formed in a lower-right corner of the indoor side panel (12), and an air discharge side inlet (15) is formed in an upper-left corner of the indoor side panel (12).

Housed in the casing (10) are four partition plates (21, 24, 34, 31). These partition plates (21, 24, 34, 31) are standingly arranged in that order from near to far side, dividing an interior space of the casing (10) front-to-rear. In addition, each of these internal spaces of the casing (10) divided by the partition plates (21, 24, 34, 31) is further divided into an upper space and a lower space.

Divisionally formed between the outdoor side panel (11) and the first partition plate (21) are an upper-situated, first upper flow path (41) and a lower-situated, first lower flow path (42). The first upper flow path (41) communicates with an outdoor space through the air supply side inlet (13). The first lower flow path (42) communicates with the outdoor space through the air discharge side outlet (16). The first cooling heat exchanger (93) is disposed in the first lower flow path (42). In addition, the compressor (91) is disposed to the left of a space defined between the outdoor side panel (11) and the first partition panel (21).

The two rotary dampers (71, 72) are arranged side by side, in a lateral row, between the first partition plate (21) and the second partition plate (24). More specifically, the first rotary damper (71) is disposed to the right and the second rotary damper (72) is disposed to the left. The rotary dampers (71, 72) are disposed in such orientation that their respective end surface portions (75) face in the direction of the second partition plate (24). In addition, the rotary dampers (71, 72) are arranged such that they rotate while being in contact with both the first partition plate (21) and the second partition plate (24).

The space between the first partition plate (21) and the second partition plate (24) is divided into an upper space and a lower space. Each of the upper and lower spaces is further divided, by the first and second rotary dampers (71, 72), into three sections. Divisionally formed on the right side of the first rotary damper (71) are an upper-situated, second upper-right flow path (43) and a lower-situated, second lower-right flow path (44). Divisionally formed between the first rotary damper (71) and the second rotary damper (72) are an upper-situated, second upper-central flow path (45) and a lower-situated, second lower-central flow path (46). Further, divisionally formed on the left side of the second rotary damper (72) are an upper-situated, second upper-left flow path (47) and a lower-situated, second lower-left flow path (48).

The first partition plate (21) is provided with the following two openings (22) and (23). The first right side opening (22) which is opened on the right side is a circular opening formed at a position corresponding to the first rotary damper (71). The first left side opening (23) which is opened on the left side is a circular opening formed at a position corresponding to the second rotary damper (72). The first right side opening (22) and the first left side opening (23) are each provided with an opening/closing shutter. By virtue of the operation of these opening/closing shutters, each of the first right side opening (22) and the first left side opening (23) is allowed to switch between a state in which only an upper half portion of the opening area is placed in the open state, and a state in which only a lower half portion of the opening area is placed in the open state. Each opening/closing shutter constitutes a switching mechanism.

The two adsorption elements (81, 82) are arranged, in a lateral row, between the second partition plate (24) and the third partition plate (34). More specifically, the first adsorption element (81) is disposed to the right and the second adsorption element (82) is disposed to the left. These adsorption elements (81, 82) are arranged in parallel in such orientation that their respective longitudinal directions correspond to the longitudinal direction of the casing (10). In addition, as shown in FIG. 4, the adsorption elements (81, 82) are disposed in such orientation that their end surfaces each form a rhombic shape as a result of rotation of a square shape for an angle of 45 degrees. In other words, the adsorption elements (81, 82) are disposed in such orientation that one end-surface diagonal line of the adsorption element (81) is collinear with its corresponding end-surface diagonal line of the adsorption element (82). Furthermore, each of the adsorption elements (81, 82) is formed rotatably on an axis passing through its end-surface center.

The space between the second partition plate (24) and the third partition plate (34) is divided into an upper space and a lower space. Each of the upper and lower spaces is further divided, by the first and second adsorption elements (81, 82), into three sections. In other words, divisionally formed on the right side of the first adsorption element (81) are an upper-situated, third upper-right flow path (51) and a lower-situated, third lower-right flow path (52). An upper-situated, third upper-central flow path (53) and a lower-situated, third lower-central flow path (54) are divisionally formed between the first adsorption element (81) and the second adsorption element (82). Divisionally formed on the left side of the second adsorption element (82) are an upper-situated, third upper-left flow path (55) and a lower-situated, third lower-left flow path (56). The third lower-central flow path (54) constitutes an air flow path for regeneration. The regenerative heat exchanger (92) of the refrigerant circuit is disposed in such orientation that it crosses the third lower-central flow path (54).

The second partition plate (24) is provided with the following five openings. The second upper-right opening (25) opening in an upper-right corner of the second partition plate (24) establishes communication between the second upper-right flow path (43) and the third upper-right flow path (51). The second lower-right opening (26) opening in a lower-right corner establishes communication between the second lower-right flow path (44) and the third lower-right flow path (52). The second central opening (27) opening in an upper-central portion establishes communication between the second upper-central flow path (45) and the third upper-central flow path (53). The second upper-left opening (28) opening at an upper-left corner establishes communication between the second upper-left flow path (47) and the third upper-left flow path (55). Finally, the second lower-left opening (29) opening at a lower-left corner establishes communication between the second lower-left flow path (48) and the third lower-left flow path (56).

The second upper-right opening (25), the second lower-right opening (26), the second central opening (27), the second upper-left opening (28), and the second lower-left opening (29) are each provided with an opening/closing shutter. By virtue of the operation of the opening/closing shutters, the second upper-right opening (25), the second lower-right opening (26), the second central opening (27), the second upper-left opening (28), and the second lower-left opening (29) are each allowed to switch between a communicating state and a shutoff state. Each opening/closing shutter constitutes an opening/closing mechanism.

The two rotary dampers (73, 74) are arranged, in a lateral row, between the third partition plate (34) and the fourth partition plate (31). More specifically, the third rotary damper (73) is disposed to the right and the fourth rotary damper (74) is disposed to the left. The rotary dampers (73, 74) are disposed in such orientation that their respective end surface portions (75) face in the direction of the third partition plate (34). In addition, the rotary dampers (73, 74) are arranged such that they rotate while being in contact with both the third partition plate (34) and the fourth partition plate (31).

The space between the third partition plate (34) and the fourth partition plate (31) is divided into an upper space and a lower space. Each of the upper and lower spaces is further divided, by the third and fourth rotary dampers (73, 74), into three sections. In other words, divisionally formed on the right side of the third rotary damper (73) are an upper-situated, fourth upper-right flow path (63) and a lower-situated, fourth lower-right flow path (64). An upper-situated, fourth upper-central flow path (65) and a lower-situated, fourth lower-central flow path (66) are divisionally formed between the third rotary damper (73) and the fourth rotary damper (74). Divisionally formed on the left side of the fourth rotary damper (74) are an upper-situated, fourth upper-left flow path (67) and a lower-situated, fourth lower-left flow path (68).

The third partition plate (34) is provided with the following five openings. The third upper-right opening (35) opening in an upper-right corner of the third partition plate (34) establishes communication between the third upper-right flow path (51) and the fourth upper-right flow path (63). The third lower-right opening (36) opening at a lower-right corner establishes communication between the third lower-right flow path (52) and the fourth lower-right flow path (64). The third central opening (37) opening in an upper central portion establishes communication between the third upper-central flow path (53) and the fourth upper-central flow path (65). The third upper-left opening (38) opening in an upper-left corner establishes communication between the third upper-left flow path (55) and the fourth upper-left flow path (67). Finally, the third lower-left opening (39) opening in a lower-left corner establishes communication between the third lower-left flow path (56) and the fourth lower-left flow path (68).

The third upper-right opening (35), the third lower-right opening (36), the third central opening (37), the third upper-left opening (38), and the third lower-left opening (39) are each provided with an opening/closing shutter. By virtue of the operation of the opening/closing shutters, the third upper-right opening (35), the third lower-right opening (36), the third central opening (37), the third upper-left opening (38), and the third lower-left opening (39) are each allowed to switch between a communicating state and a shutoff state. Each opening/closing shutter constitutes an opening/closing mechanism.

The fourth partition plate (31) is provided with the following two openings. The fourth right side opening (32) opening on the right side is a circular opening which is formed at a position corresponding to the third rotary damper (73). The fourth left side opening (33) opening on the left side is a circular opening which is formed at a position corresponding to the fourth rotary damper (74). The fourth right side opening (32) and the fourth left side opening (33) are each provided with an opening/closing shutter. By virtue of the operation of the opening/closing shutters, the fourth right side opening (32) and the fourth left side opening (33) are each allowed to switch between a state in which only an upper half portion of the opening area is placed in the open state, and a state in which only a lower half portion of the opening area is placed in the open state. Each opening/closing shutter constitutes an opening/closing mechanism.

Divisionally formed between the fourth partition plate (31) and the indoor side panel (12) are an upper-situated, fifth upper flow path (61) and a lower-situated, fifth lower flow path (62). The fifth upper flow path (61) is brought into communication with an indoor space by the air discharge side inlet (15). The fifth upper flow path (61) is provided with an air discharge fan (96). On the other hand, the fifth lower flow path (62) is brought into communication with the indoor space by the air supply side outlet (14). The fifth lower flow path (62) is provided with an air supply fan (95) and a second cooling heat exchanger (94).

Running Operation

The basic operation of the adsorption elements (81, 82) will be described first and then the running operation of the above-described air conditioning apparatus will be described more particularly.

Figure 9:
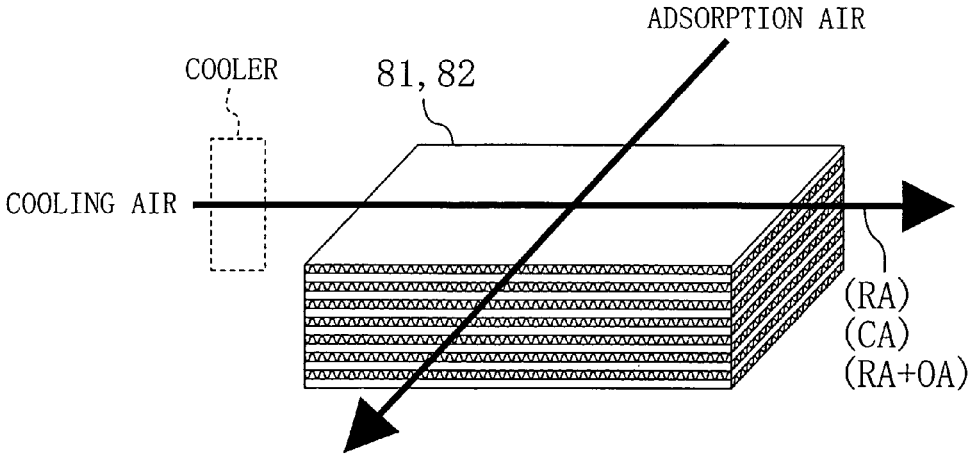
FIG. 9 is a perspective illustration showing the action of an adsorption element.

Referring to FIG. 9, a stream of adsorption air is flowing through the humidity adjusting side passageway (85) and a stream of cooling air is flowing through the cooling side passageway (86) in the adsorption element (81, 82). In this state, moisture contained in the adsorption air is adsorbed onto the adsorbent in the humidity adjusting side passageway (85). As a result, the adsorption air is dehumidified. At this time, heat of adsorption is generated. However, the heat of adsorption is collected by the cooing air flowing through the cooling side passageway (86).

Here, if outdoor air (OA) is used as cooling air, there is a drop in cooling effect when the outside temperature is high. This results in a rise in temperature of the adsorption element (81, 82), thereby making it impossible to gain a sufficient amount of moisture removal. Especially the temperature gradient of the adsorption air from inlet side to outlet side increases, as a result of which the amount of moisture removal at the outlet side tends to become insufficient. On the contrary, when air lower in temperature than the outdoor air (OA) is used as cooling air, the temperature rise on the adsorption side is suppressed. As a result, especially the temperature gradient from inlet side to outlet side decreases, thereby making it possible to gain a sufficient amount of moisture removal.

For example, room air (RA) may be used as cooling air. In addition, conditioned air (CA) cooled by a cooler indicated by broken line can be used as cooling air. Since the use of the conditioned air (CA) makes it possible for the adsorption element (81, 82) to be cooled by air lower in temperature than the room air (RA), the cooling effect is enhanced to a further extent, thereby making it possible to gain a sufficient amount of moisture removal.

In addition, a stream of mixed air (RA+OA), i.e., a combination of room air (RA) and outdoor air (OA), may be used as cooling air. The running operation of the foregoing air conditioning apparatus, when the mixed air (RA+OA) which is a combination of room air (RA) and outdoor air (OA) is used as cooling air, will be described more particularly, with reference to FIGS. 4–8. FIG. 4 is a diagram schematically illustrating portions between the second partition plate (24) and the third partition plate (34) in the casing (10).

Dehumidification Operating Mode

During the dehumidification operating mode, outdoor air (OA) is dehumidified and then is supplied into an indoor space while heat of adsorption, generated in the adsorption element (81, 82) when dehumidifying the outdoor air (OA), is collected by mixed air (RA+OA) which is a combination of room air (RA) and outdoor air (OA) and then is discharged.

Figure 5:
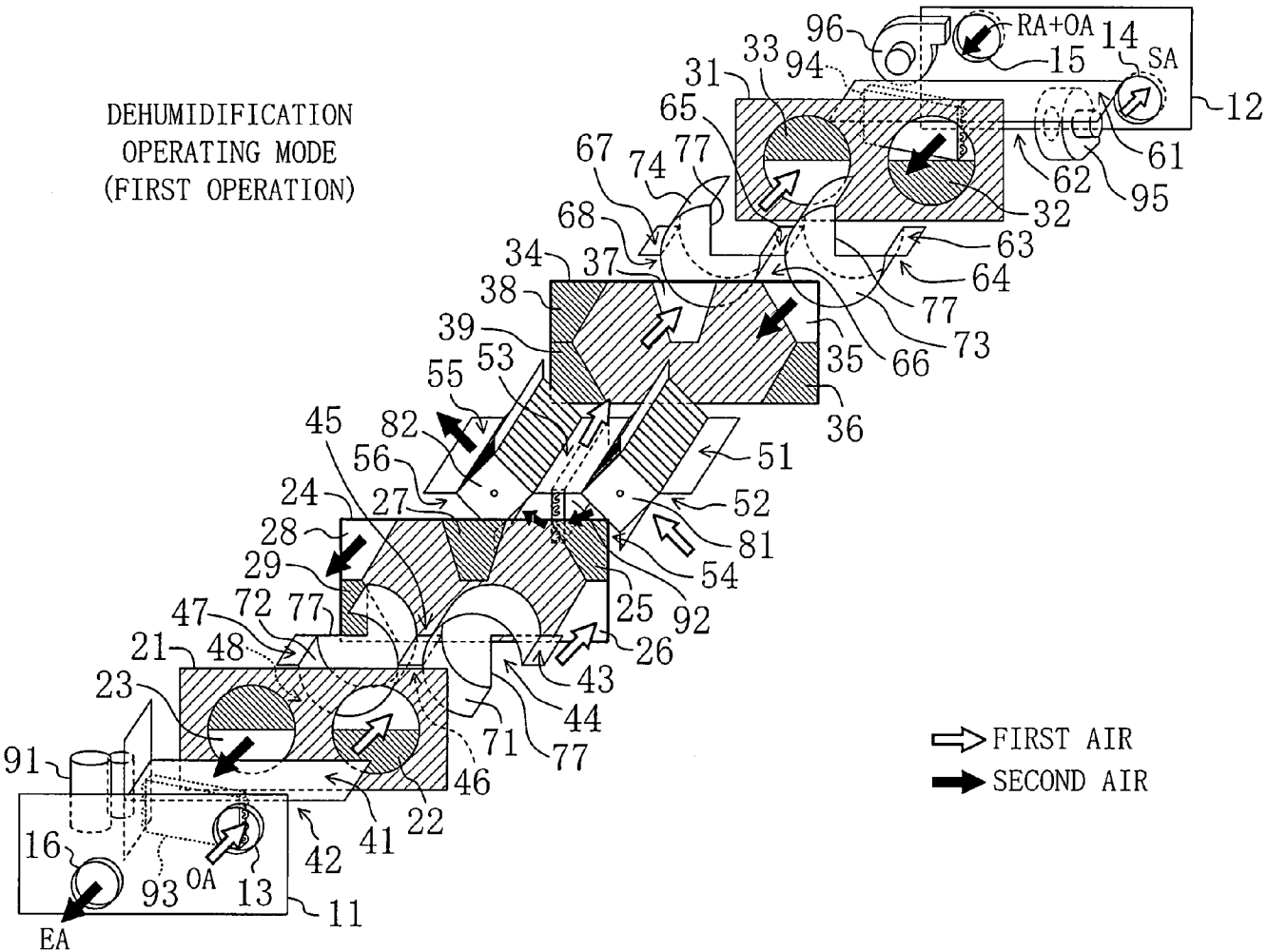
FIG. 5 is an exploded perspective view describing a first operation in a dehumidification operating mode of the air conditioning apparatus according to the first embodiment.
Figure 6:
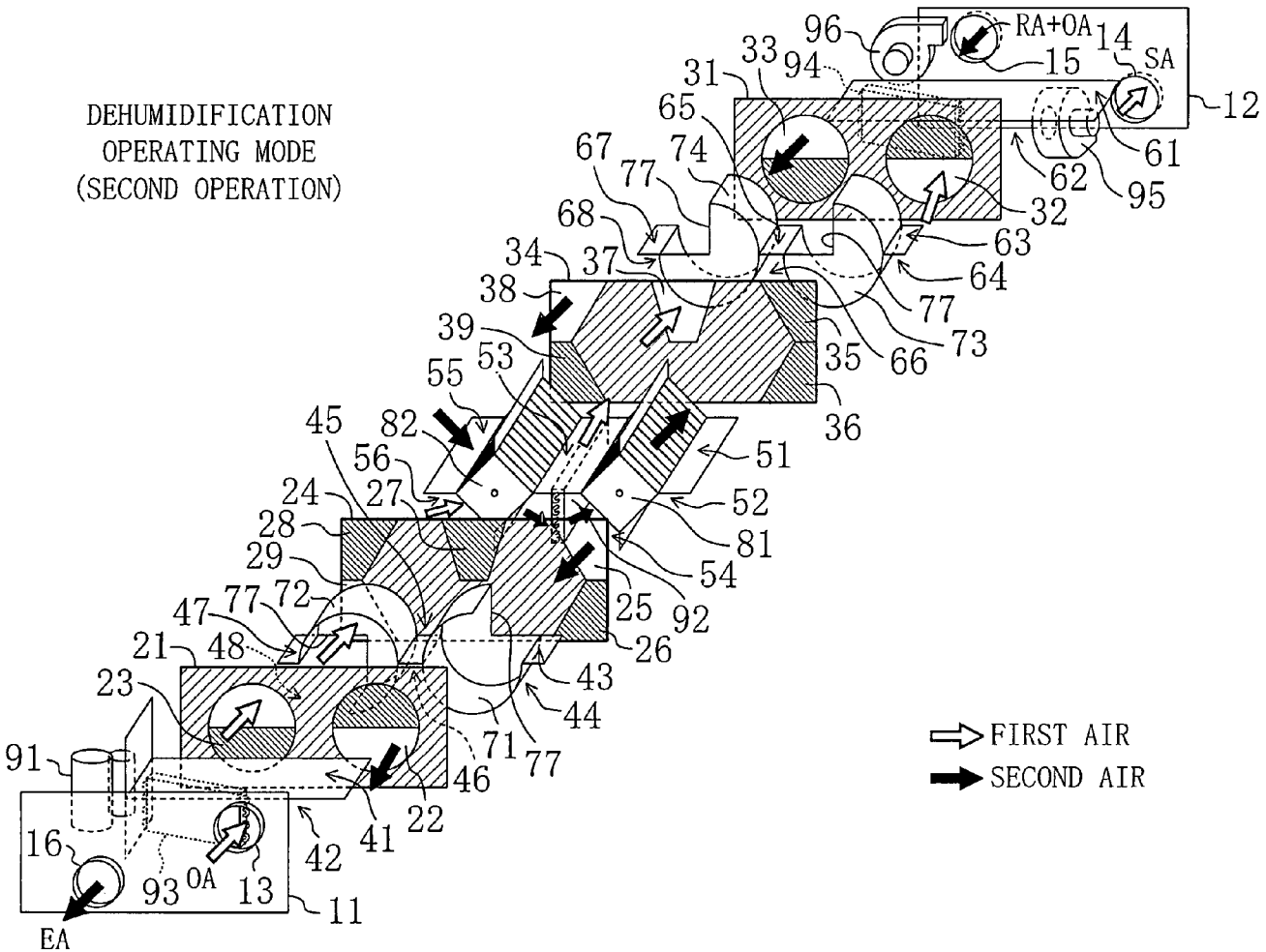
FIG. 6 is an exploded perspective view describing a second operation in the dehumidification operating mode of the air conditioning apparatus according to the first embodiment.

As shown in FIGS. 5 and 6, when the air supply fan (95) is activated in the dehumidification operating mode, outdoor air (OA) is taken into the inside of the casing (10) through the air supply side inlet (13). The outdoor air (OA) flows, as first air which constitutes adsorption air, into the first upper flow path (41). On the other hand, when the air discharge fan (96) is activated, mixed air (RA+OA) which is a combination of room air (RA) and outdoor air (OA) is taken into the inside of the casing (10) through the air discharge side inlet (15). The mixed air (RA+OA) flows, as second air which constitutes cooling air and regeneration air, into the fifth upper flow path (61).

Furthermore, during the dehumidification operating mode, refrigeration cycles are carried out in the refrigerant circuit, in which the regenerative heat exchanger (92) operates as a condenser and the second cooling heat exchanger (94) operates as an evaporator. Stated another way, no refrigerant flows in the first cooling heat exchanger (93) in the dehumidification operating mode. And, the dehumidification operating mode of the air conditioning apparatus is performed by repeating first and second operations in alternation.

Referring to FIG. 5, the first operation of the dehumidification operating mode will be described. In the first operation, an adsorption operation and a cooling operation for the first adsorption element (81) are carried out while a regeneration operation for the second adsorption element (82) is carried out. Stated another way, during the first operation, air is dehumidified in the first adsorption element (81) and the element (81) is cooled while simultaneously the adsorbent of the second adsorption element (82) is regenerated.

In addition, in the first operation, the second upper-right opening (25), the second central opening (27), and the second lower-left opening (29) are placed in the closed state in the second partition plate (24). Furthermore, the third lower-right opening (36), the third upper-left opening (38), and the third lower-left opening (39) are placed in the closed state in the third partition plate (34).

An upper half portion of the first right side opening (22) is placed in the open state. The notched opening (77) of the first rotary damper (71) is oriented such that it is located lower-right and opens to the second lower-right flow path (44). The second lower-right opening (26) of the second partition plate (24) is in the communicating state. In this state, the first air, which has flowed into the first upper flow path (41), passes through the first right side opening (22), the inside of the first rotary damper (71), the second lower-right flow path (44), and the second lower-right opening (26) in that order, and flows into the third lower-right flow path (52).

An upper half portion of the fourth right side opening (32) is placed in the open state. The notched opening (77) of the third rotary damper (73) is oriented such that it is located upper-right and opens to the fourth upper-right flow path (63). The third upper-right opening (35) of the third partition plate (34) is in the communicating state. In this state, the second air, which has flowed into the fifth upper flow path (61), passes through the fourth right side opening (32), the inside of the third rotary damper (73), the fourth upper-right flow path (63), and the third upper-right opening (35) in that order, and flows into the third upper-right flow path (51).

The humidity adjusting side passageway (85) of the first adsorption element (81) is in communication with the third lower-right flow path (52) as well as with the third upper-central flow path (53). The cooling side passageway (86) of the first adsorption element (81) is in communication with the third upper-right flow path (51) as well as with the third lower-central flow path (54). On the other hand, the humidity adjusting side passageway (85) of the second adsorption element (82) is in communication with the third lower-central flow path (54) as well as with the third upper-left flow path (55). The cooling side passageway (86) of the second adsorption element (82) is in communication with the third upper-central flow path (53) as well as with the third lower-left flow path (56).

Figure 4A:
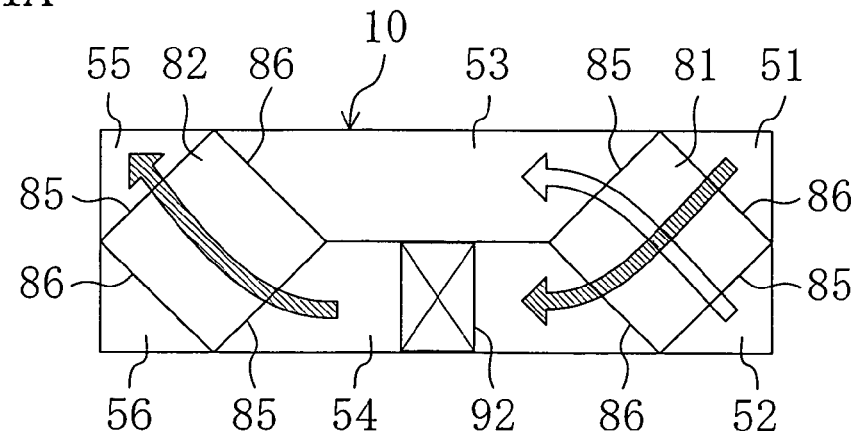
FIG. 4 is a diagram schematically showing principal parts of the air conditioning apparatus according to the first embodiment.

As also shown in FIG. 4A, in this state the first air flows, as adsorption air, into the humidity adjusting side passageway (85) of the first adsorption element (81) from the third lower-right flow path (52). During the flow through the humidity adjusting side passageway (85), water vapor contained in the first air is adsorbed onto the adsorbent. The first air thus dehumidified in the humidity adjusting side passageway (85) flows into the third upper-central flow path (53).

On the other hand, the second air flows into the cooling side passageway (86) of the first adsorption element (81) from the third upper-right flow path (51). During the flow through the cooling side passageway (86), the second air absorbs heat of adsorption generated when the water vapor is adsorbed onto the adsorbent in the humidity adjusting side passageway (85). In other words, the second air flows, as cooling air, through the cooling side passageway (86). The second air, which has robbed the heat of adsorption, flows into the third lower-central flow path (54). During the flow through the third lower-central flow path (54), the second air passes through the regenerative heat exchanger (92). In the regenerative heat exchanger (92), the second air is subjected to heat exchange with refrigerant and absorbs heat of condensation of the refrigerant.

The second air heated by the first adsorption element (81) and the regenerative heat exchanger (92) is introduced into the humidity adjusting side passageway (85) of the second adsorption element (82). In the humidity adjusting side passageway (85), the adsorbent is heated by the second air and, as a result, water vapor is desorbed from the adsorbent. In other words, the adsorbent is regenerated. Then, the water vapor desorbed from the adsorbent flows, together with the second air, into the third upper-left flow path (55).

The third central opening (37) of the third partition plate (34) is in the communicating state. The notched opening (77) of the fourth rotary damper (74) is oriented such that it is located upper-right and opens to the fourth upper-central flow path (65). A lower half portion of the fourth left side opening (33) is in the open state. In this state, the first air dehumidified by the first adsorption element (81) passes through the third upper-central flow path (53), the third central opening (37), the fourth upper-central flow path (65), the inside of the fourth rotary damper (74), and the fourth left side opening (33) in that order, and flows into the fifth lower flow path (62).

During the flow through the fifth lower flow path (62), the first air passes through the second cooling heat exchanger (94). In the second cooling heat exchanger (94), the first air is subjected to heat exchange with refrigerant and liberates heat to the refrigerant. And, the first air dehumidified and cooled passes through the air supply side outlet (14) and is supplied indoors.

The second upper-left opening (28) of the second partition plate (24) is in the communicating state. The notched opening (77) of the second rotary damper (72) is oriented such that it is located upper-left and opens to the second upper-left flow path (47). A lower half portion of the first left side opening (23) is in the open state. In this state, the second air, which has flowed out of the second adsorption element (82), passes through the third upper-left flow path (55), the second upper-left opening (28), the second upper-left flow path (47), the inside of the second rotary damper (72), and the first left side opening (23) in that order, and flows into the first lower flow path (42).

During the flow through the first lower flow path (42), the second air passes through the first cooling heat exchanger (93). At this time, no refrigerant is flowing through the first cooling heat exchanger (93). Accordingly, the second air just passes through the first cooling heat exchanger (93), in other words the second air neither absorbs nor liberates heat. Thereafter, the second air passes through the air discharge side outlet (16) and is discharged outdoors.

Referring to FIG. 6, the second operation of the dehumidification operating mode will be described. In the second operation, an adsorption operation and a cooling operation for the second adsorption element (82) are carried out while a regeneration operation for the first adsorption element (81) is carried out. In other words, during the second operation, air is dehumidified in the second adsorption element (82) and the element (82) is cooled while simultaneously the absorbent of the first adsorption element (81) is regenerated.

In addition, in the second operation, the second lower-right opening (26), the second central opening (27), and the second upper-left opening (28) are closed in the second partition plate (24). Furthermore, the third upper-right opening (35), the third lower-right opening (36), and the third lower-left opening (39) are closed in the third partition plate (34).

An upper half portion of the first left side opening (23) is placed in the open state. The notched opening (77) of the second rotary damper (72) is oriented such that it is located lower-left and opens to the second lower-left flow path (48). The second lower-left opening (29) of the second partition plate (24) is in the communicating state. In this communicating state, the first air, which has flowed into the first upper flow path (41), passes through the first left side opening (23), the inside of the second rotary damper (72), the second lower-left flow path (48), and the second lower-left opening (29) in that order, and flows into the third lower-left flow path (56).

An upper half portion of the fourth left side opening (33) is placed in the open state. The notched opening (77) of the fourth rotary damper (74) is oriented such that it is located upper-left and opens to the fourth upper-left flow path (67). The third upper-left opening (38) of the third partition plate (34) is in the communicating state. In this communicating state, the second air, which has flowed into the fifth upper flow path (61), passes through the fourth left side opening (33), the inside of the fourth rotary damper (74), the fourth upper-left flow path (67), and the third upper-left opening (38) in that order, and flows into the third upper-left flow path (55).

Figure 4B:
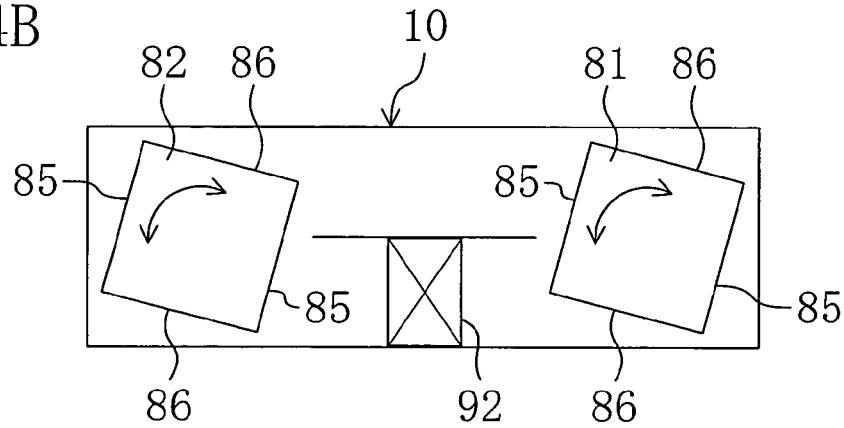

At the time of switching from the first operation to the second operation, the first adsorption element (81) and the second adsorption element (82) are rotated through an angle of 90 degrees (see FIG. 4B). And, the humidity adjusting side passageway (85) of the second adsorption element (82) is in communication with the third lower-left flow path (56) as well as with the third upper-central flow path (53). The cooling side passageway (86) of the second adsorption element (82) is in communication with the third upper-left flow path (55) as well as with the third lower-central flow path (54). On the other hand, the humidity adjusting side passageway (85) of the first adsorption element (81) is in communication with the third lower-central flow path (54) as well as with the third upper-right flow path (51). The cooling side passageway (86) of the first adsorption element (81) is in communication with the third upper-central flow path (53) as well as with the third lower-right flow path (52).

Figure 4C:
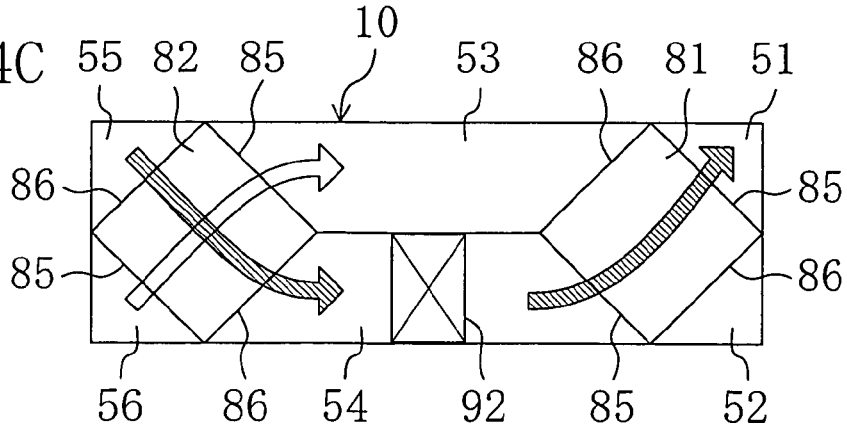

As also shown in FIG. 4C, in this state, the first air flows, as adsorption air, into the humidity adjusting side passageway (85) of the second adsorption element (82) from the third lower-left flow path (56). During the flow through the humidity adjusting side passageway (85), water vapor contained in the first air is adsorbed onto the adsorbent. The first air dehumidified in the humidity adjusting side passageway (85) flows into the third upper-central flow path (53).

On the other hand, the second air flows into the cooling side passageway (86) of the second adsorption element (82) from the third upper-left flow path (55). During the flow through the cooling side passageway (86), the second air absorbs heat of adsorption generated when the water vapor is adsorbed onto the adsorbent in the humidity adjusting side passageway (85). Stated another way, the second air flows, as cooling air, through the cooling side passageway (86). The second air, which has robbed the heat of adsorption, flows into the third lower-central flow path (54). During the flow through the third lower-central flow path (54), the second air passes through the regenerative heat exchanger (92). In the regenerative heat exchanger (92), the second air is subjected to heat exchange with refrigerant and absorbs heat of condensation of the refrigerant.

The second air heated in the second adsorption element (82) and the regenerative heat exchanger (92) is introduced, as regeneration air, into the humidity adjusting side passageway (85) of the first adsorption element (81). In the humidity adjusting side passageway (85), the adsorbent is heated by the second air and, as a result, water vapor is desorbed from the adsorbent. In other words, the adsorbent is regenerated. The water vapor desorbed from the adsorbent flows, together with the second air, into the third upper-right flow path (51).

The third central opening (37) of the third partition plate (34) is in the communicating state. The notched opening (77) of the third rotary damper (73) is oriented such that it is located upper-left and opens to the fourth upper-central flow path (65). A lower half portion of the fourth right side opening (32) is placed in the open state. In this state, the first air dehumidified in the second adsorption element (82) passes through the third upper-central flow path (53), the third central opening (37), the fourth upper-central flow path (65), the inside of the third rotary damper (73), and the fourth right side opening (32) in that order, and flows into the fifth lower flow path (62).

During the flow through the fifth lower flow path (62), the first air passes through the second cooling heat exchanger (94). In the second cooling heat exchanger (94), the first air is subjected to heat exchange with refrigerant and liberates heat to the refrigerant. And the first air dehumidified and cooled passes through the air supply side outlet (14) and is supplied indoors.

The second upper-right opening (25) of the second partition plate (24) is in the communicating state. The notched opening (77) of the first rotary damper (71) is oriented such that it is located upper-right and opens to the second upper-right flow path (43). A lower half portion of the first right side opening (22) is placed in the open state. In this state, the second air, which has flowed out of the first adsorption element (81), passes through the third upper-right flow path (51), the second upper-right opening (25), the second upper-right flow path (43), the inside of the first rotary damper (71), and the first right side opening (22) in that order, and flows into the first lower flow path (42).

During the flow through the first lower flow path (42), the second air passes through the first cooling heat exchanger (93). At this time, no refrigerant is flowing in the first cooling heat exchanger (93). Accordingly, the second air just passes through the first cooling heat exchanger (93), in other words, the second air neither absorbs nor liberates heat. Thereafter, the second air passes through the air discharge side outlet (16) and is discharged outdoors.

As described above, during the first operation, an adsorption operation and a cooling operation for the first adsorption element (81) are carried out while a regeneration operation for the second adsorption element (82) is carried out. On the other hand, during the second operation, a regeneration operation for the first adsorption element (81) is carried out while an adsorption operation and a cooling operation for the second adsorption element (82) are carried out.

At that time, heat of adsorption generated in the humidity adjusting side passageway (85) of each adsorption element (81, 82) is collected by the second air flowing through the cooling side passageway (86). Because of this, the adsorption element (81, 82) is cooled by the second air, thereby suppressing the temperature rise of the adsorption element (81, 82). In other words, although water vapors contained in the first air will not adsorb easily onto the adsorption element (81, 82) when the relative humidity falls due to the rise in the temperature of the first air caused by heat of adsorption, the amount of moisture adsorbable onto the adsorption element (81, 82) is secured because the temperature rise of the first air is suppressed by adsorption-heat absorption by the second air and the drop in relative humidity can be held low. In addition, room air (RA) is used as second air constituting cooling air, whereby the humidity adjusting side passageway (85) is cooled efficiently.

On the other hand, when the amount of moisture adsorption in the humidity adjusting side passageway (85) increases, regeneration air is forced to flow, as second air, through the humidity adjusting side passageway (85). As a result, moisture present in the humidity adjusting side passageway (85) is discharged to the second air, whereby the adsorption element (81, 82) is regenerated.

In the way as described above, as cooling air flowing through the adsorption element (81, 82) during the cooling mode of operation, mixed air (RA+OA) which is a combination of room air (RA) and outdoor air (OA) is used. As a result of such arrangement, it becomes possible to efficiently cool the adsorption element (81, 82) and to prevent the occurrence of performance decrement.

Humidification Operating Mode

Figure 7:
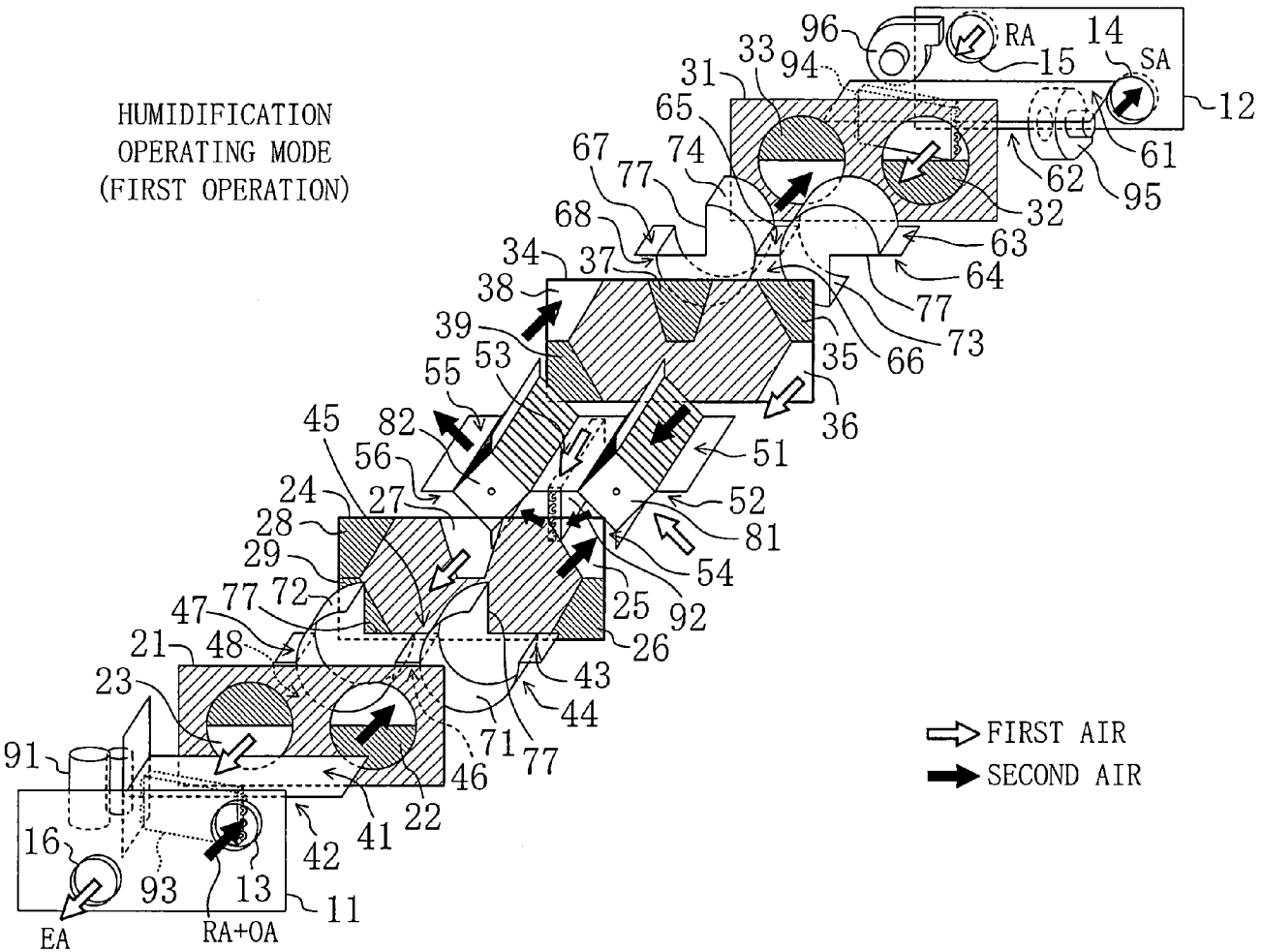
FIG. 7 is an exploded perspective view describing a first operation in a humidification operating mode of the air conditioning apparatus according to the first embodiment.
Figure 8:
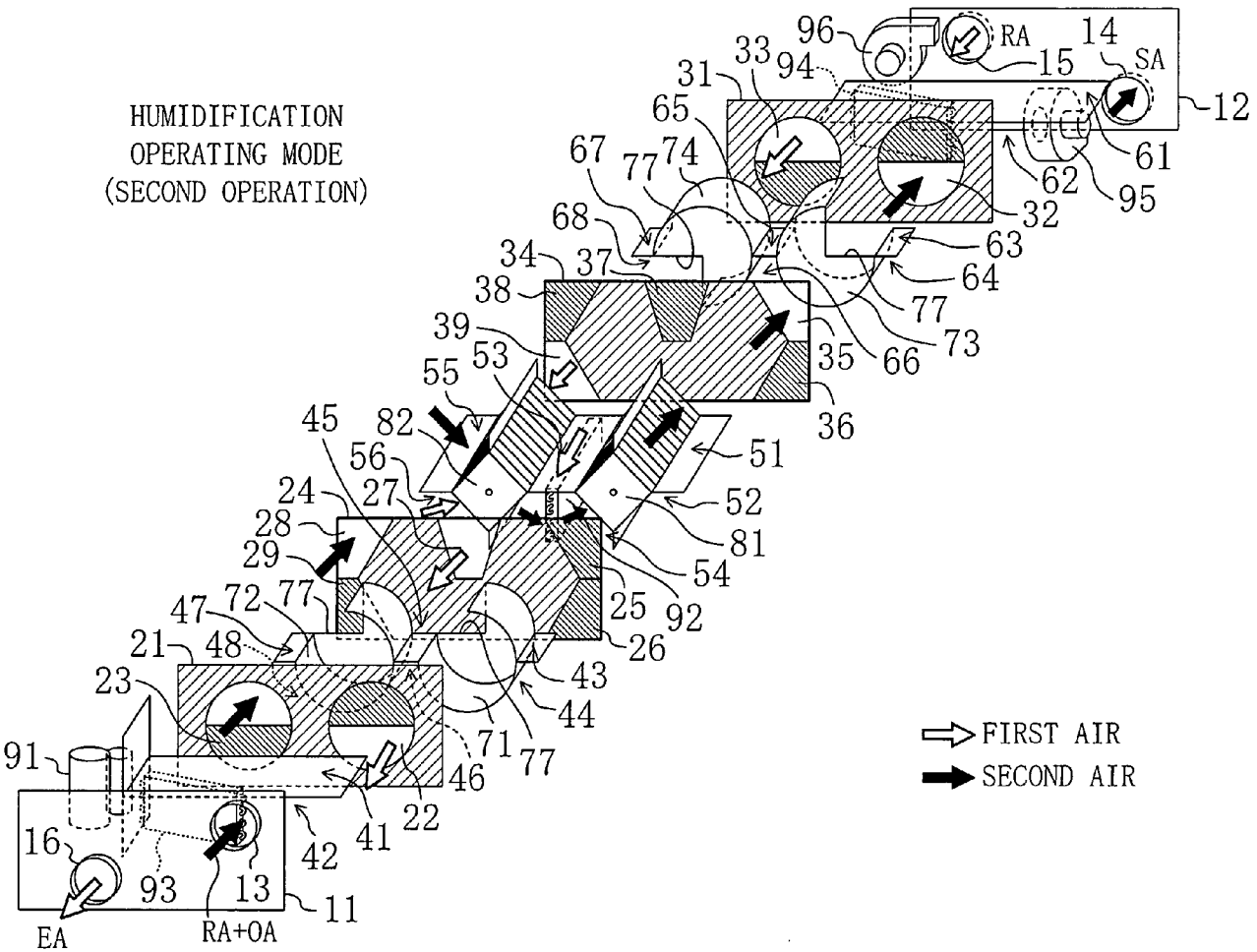
FIG. 8 is an exploded perspective view describing a second operation in the humidification operating mode of the air conditioning apparatus according to the first embodiment.

During the humidification operating mode, mixed air (RA+OA) made up of room air (RA) and outdoor air (OA) is humidified and then is supplied into an indoor space. As shown in FIGS. 7 and 8, when the air supply fan (95) is activated in the humidification operating mode, mixed air (RA+OA), i.e., a combination of room air (RA) and outdoor air (OA), is taken into the inside of the casing (10) through the air supply side inlet (13). The mixed air (RA+OA) flows, as second air which constitutes cooling air and regeneration air, into the first upper flow path (41). On the other hand, when the air discharge fan (96) is activated, room air (OA) is taken into the inside of the casing (10) through the air discharge side inlet (15). The room air (RA) flows, as first air which constitutes adsorption air, into the fifth upper flow path (61).

Furthermore, in the humidification operating mode, refrigeration cycles are carried out in the refrigerant circuit, in which the regenerative heat exchanger (92) operates as a condenser and the first cooling heat exchanger (93) operates as an evaporator. Stated another way, no refrigerant flows in the second cooling heat exchanger (94) in the humidification operating mode. And, the humidification operating mode of the air conditioning apparatus is performed by repeating first and second operations in alternation.

Referring to FIG. 7, the first operation of the humidification operating mode will be described. In the first operation, an adsorption operation and a cooling operation for the first adsorption element (81) are carried out while a regeneration operation for the second adsorption element (82) is carried out. In other words, in the first operation, air is humidified in the second adsorption element (82) and the adsorbent of the first adsorption element (81) adsorbs water vapor.

In addition, in the first operation, the second lower-right opening (26), the second upper-left opening (28), and the second lower-left opening (29) are closed in the second partition plate (24). Furthermore, the third upper-right opening (35), the third central opening (37), and the third lower-left opening (39) are closed in the third partition plate (34).

An upper half portion of the first right side opening (22) is placed in the open state. The notched opening (77) of the first rotary damper (71) is oriented such that it is located upper-right and opens to the second upper-right flow path (43). The second upper-right opening (25) of the second partition plate (24) is in the communicating state. In this state, the second air, which has flowed into the first upper flow path (41), passes through the first right side opening (22), the inside of the first rotary damper (71), the second upper-right flow path (43), and the second upper-right opening (25) in that order, and flows into the third upper-right flow path (51).

An upper half portion of the fourth right side opening (32) is placed in the open state. The notched opening (77) of the third rotary damper (73) is oriented such that it is located lower-right and opens to the fourth lower-right flow path (64). The third lower-right opening (36) of the third partition plate (34) is in the communicating state. In this state, the first air, which has flowed into the fifth upper flow path (61), passes through the fourth right side opening (32), the inside of the third rotary damper (73), the fourth lower-right flow path (64), and the third lower-right opening (36) in that order, and flows into the third lower-right flow path (52).

As shown in FIG. 4A, the humidity adjusting side passageway (85) of the first adsorption element (81) is in communication with the third lower-right flow path (52) as well as with the third upper-central flow path (53). The cooling side passageway (86) of the first adsorption element (81) is in communication with the third upper-right flow path (51) as well as with the third lower-central flow path (54). On the other hand, the humidity adjusting side passageway (85) of the second adsorption element (82) is in communication with the third lower-central flow path (54) as well as with the third upper-left flow path (55). The cooling side passageway (86) of the second adsorption element (82) is in communication with the third upper-central flow path (53) as well as with the third lower-left flow path (56).

In this state, the first air flows, as adsorption air, into the humidity adjusting side passageway (85) of the first adsorption element (81) from the third lower-right flow path (52). During the flow through the humidity adjusting side passageway (85), water vapor contained in the first air is adsorbed onto the adsorbent. The first air dehumidified in the humidity adjusting side passageway (85) flows into the third upper-central flow path (53).

On the other hand, the second air flows into the cooling side passageway (86) of the first adsorption element (81) from the third upper-right flow path (51). During the flow through the cooling side passageway (86), the second air absorbs heat of adsorption generated when the water vapor was adsorbed onto the adsorbent in the humidity adjusting side passageway (85). In other words, the second air flows, as cooling air, through the cooling side passageway (86). The second air, which has robbed the heat of adsorption, flows into the third lower-central flow path (54). During the flow through the third lower-central flow path (54), the second air passes through the regenerative heat exchanger (92). In the regenerative heat exchanger (92), the second air is subjected to heat exchange with refrigerant and absorbs heat of condensation of the refrigerant.

The second air heated in the first adsorption element (81) and the regenerative heat exchanger (92) is introduced, as regeneration air, into the humidity adjusting side passageway (85) of the second adsorption element (82). In the humidity adjusting side passageway (85), the adsorbent is heated by the second air and, as a result, water vapor is desorbed from the adsorbent. In other words, the adsorbent is regenerated. And, the water vapor desorbed from the adsorbent is given to the second air and the second air is humidified accordingly. The second air humidified in the second adsorption element (82) flows into the third upper-left flow path (55).

The third upper-left opening (38) of the third partition plate (34) is in the communicating state. The notched opening (77) of the fourth rotary damper (74) is oriented such that it is located upper-left and opens to the fourth upper-left flow path (67). A lower half portion of the fourth left side opening (33) is placed in the open state. In this state, the second air humidified in the second adsorption element (82) passes through the third upper-left flow path (55), the third upper-left opening (38), the fourth upper-left flow path (67), the inside of the fourth rotary damper (74), and the fourth left side opening (33) in that order, and then flows into the fifth lower flow path (62).

During the flow through the fifth lower flow path (62), the second air passes through the second cooling heat exchanger (94). At this time, no refrigerant is flowing in the second cooling heat exchanger (94). Accordingly, the second air just passes through the second cooling heat exchanger (94), in other words the second air neither absorbs nor liberates heat. And, the second air heated and humidified passes through the air supply side outlet (14) and is supplied indoors.

The second central opening (27) of the second partition plate (24) is in the communicating state. The notched opening (77) of the second rotary damper (72) is oriented such that it is located upper right and opens to the second upper-central flow path (45). A lower half portion of the first left side opening (23) is placed in the open state. In this state, the first air dehumidified in the first adsorption element (81) passes through the third upper-central flow path (53), the second central opening (27), the second upper-central flow path (45), the inside of the second rotary damper (72), and the first left side opening (23) in that order, and flows into the first lower flow path (42).

During the flow through the first lower flow path (42), the first air passes through the first cooling heat exchanger (93). In the first cooling heat exchanger (93), the first air is subjected to heat exchange with refrigerant, and the refrigerant in the refrigerant circuit absorbs heat from the first air and evaporates. Thereafter, the first air passes through the air discharge side outlet (16) and is discharged outdoors.

Referring to FIG. 8, the second operation of the humidification operating mode will be described. In the second operation, an adsorption operation and a cooling operation for the second adsorption element (82) are carried out while a regeneration operation for the first adsorption element (81) is carried out. In other words, in the second operation, air is humidified in the first adsorption element (81) and the adsorbent of the second adsorption element (82) adsorbs water vapor.

In the second operation, the second upper-right opening (25), the second lower-right opening (26), and the second lower-left opening (29) are closed in the second partition plate (24). Furthermore, the third lower-right opening (36), the third central opening (37), and the third upper-left opening (38) are closed in the third partition plate (34).

An upper half portion of the first left side opening (23) is placed in the open state. The notched opening (77) of the second rotary damper (72) is oriented such that it is located upper-left and opens to the second upper-left flow path (47). The second upper-left opening (28) of the second partition plate (24) is in the communicating state. In this state, the second air, which has flowed into the first upper flow path (41), passes through the first left side opening (23), the inside of the second rotary damper (72), the second upper-left flow path (47), and the second upper-left opening (28) in that order, and then flows into the third upper-left flow path (55).

An upper half portion of the fourth left side opening (33) is placed in the open state. The notched opening (77) of the fourth rotary damper (74) is oriented such that it is located lower-left and opens to the fourth lower-left flow path (68). The third lower-left opening (39) of the third partition plate (34) is in the communicating state. In this state, the first air, which has flowed into the fifth upper flow path (61), passes through the fourth left side opening (33), the inside of the fourth rotary damper (74), the fourth lower-left flow path (68), and the third lower-left opening (39) in that order, and then flows into the third lower-left flow path (56).

At the time of switching from the first operation to the second operation, the first adsorption element (81) and the second adsorption element (82) are rotated through an angle of 90 degrees (see FIG. 4B). And, as shown in FIG. 4C, the humidity adjusting side passageway (85) of the second adsorption element (82) is in communication with the third lower-left flow path (56) as well as with the third upper-central flow path (53). The cooling side passageway (86) of the second adsorption element (82) is in communication with the third upper-left flow path (55) as well as with the third lower-central flow path (54). On the other hand, the humidity adjusting side passageway (85) of the first adsorption element (81) is in communication with the third lower-central flow path (54) as well as with the third upper-right flow path (51). The cooling side passageway (86) of the first adsorption element (81) is in communication with the third upper-central flow path (53) as well as with the third lower-right flow path (52).

In this state, the first air flows, as adsorption air, into the humidity adjusting side passageway (85) of the second adsorption element (82) from the third lower-left flow path (56). During the flow through the humidity adjusting side passageway (85), water vapor contained in the first air is adsorbed onto the adsorbent. The first air dehumidified in the humidity adjusting side passageway (85) flows into the third upper-central flow path (53).

Meanwhile, the second air flows into the cooling side passageway (86) of the second adsorption element (82) from the third upper-left flow path (55). During the flow through the cooling side passageway (86), the second air absorbs heat of adsorption produced when the water vapor is adsorbed onto the adsorbent in the humidity adjusting side passageway (85). In other words, the second air flows, as cooling air, through the cooling side passageway (86). The second air, which has robbed the heat of adsorption, flows into the third lower-central flow path (54). During the flow through the third lower-central flow path (54), the second air passes through the regenerative heat exchanger (92). In the regenerative heat exchanger (92), the second air is subjected to heat exchange with refrigerant and absorbs heat of condensation of the refrigerant.

The second air heated in the second adsorption element (82) and the regenerative heat exchanger (92) is introduced, as regenerating air, into the humidity adjusting side passageway (85) of the first adsorption element (81). In the humidity adjusting side passageway (85), the adsorbent is heated by the second air and, as a result, water vapor is desorbed from the adsorbent. In other words, the adsorbent is regenerated. And, the water vapor desorbed from the adsorbent is given to the second air and, as a result, the second air is humidified. The second air humidified in the first adsorption element (81) flows into the third upper-right flow path (51).

The third upper-right opening (35) of the third partition plate (34) is in the communicating state. The notched opening (77) of the third rotary damper (73) is oriented such that it is located upper-right and opens to the fourth upper-right flow path (63). A lower half portion of the fourth right side opening (32) is placed in the open state. In this state, the second air humidified in the first adsorption element (81) passes through the third upper-right flow path (51), the third upper-right opening (35), the fourth upper-right flow path (63), the inside of the third rotary damper (73), and the fourth right side opening (32) in that order, and then flows into the fifth lower flow path (62).

During the flow through the fifth lower flow path (62), the second air passes through the second cooling heat exchanger (94). At this time, no refrigerant is flowing in the second cooling heat exchanger (94). Accordingly, the second air just passes through the second cooling heat exchanger (94), in other words, the second air neither absorbs nor liberates heat. And, the second air heated and humidified passes through the air supply side outlet (14) and is supplied indoors.

The second central opening (27) of the second partition plate (24) is in the communicating state. The notched opening (77) of the first rotary damper (71) is oriented such that it is located upper-left and opens to the second upper-central flow path (45). A lower half portion of the first right side opening (22) is placed in the open state. In this state, the first air dehumidified in the second adsorption element (82) passes through the third upper-central flow path (53), the second central opening (27), the second upper-central flow path (45), the inside of the first rotary damper (71), and the first right side opening (22) in that order, and then flows into the first lower flow path (42).

During the flow through the first lower flow path (42), the first air passes through the first cooling heat exchanger (93). The first air is subjected to heat exchange with refrigerant in the first cooling heat exchanger (93) and the refrigerant in the refrigerant circuit absorbs heat from the first air and evaporates. Thereafter, the first air passes through the air discharge side outlet (16) and is discharged outdoors.

As has been described above, during the first operation, an adsorption operation and a cooling operation for the first adsorption element (81) are carried out, while a regeneration operation for the second adsorption element (82) is carried out. On the other hand, during the second operation, a regeneration operation for the first adsorption element (81) is carried out while an adsorption operation and a cooling operation for the second adsorption element (82) are carried out. At that time, heat of adsorption generated in the humidity adjusting side passageway (85) of the adsorption element (81, 82) is collected by the second air flowing through the cooling side passageway (86). Because of such arrangement, the adsorption element (81, 82) is cooled by the second air, thereby suppressing the temperature rise of the adsorption element (81, 82).

Effects of First Embodiment

In the first embodiment, heat of adsorption, generated in the humidity adjusting side passageway (85) of each of the first and second adsorption elements (81, 82) when dehumidifying the first air, is collected by mixed air (RA+OA), i.e., a combination of room air (RA) and outdoor air (OA), as second air. As a result of such arrangement, even when the outside temperature is high during the dehumidification operating mode, it becomes possible to suppress the temperature rise of the adsorption element (81, 82) by making utilization of mixed air (RA+OA) lower in temperature than outdoor air (OA). Because of such arrangement, the drop in adsorption performance of the adsorption element (81, 82) is suppressed in comparison with the conventional apparatuses, and the amount of moisture adsorbable by the adsorption element (81, 82) is secured sufficiently.

If outdoor air (OA) is heated and then supplied into the room during extremely cold climate conditions, this increases the amount of heating applied by the regenerative heat exchanger (92). On the contrary, in the present embodiment, mixed air (RA+OA) composed of room air (RA) and outdoor air (RA) is humidified and then supplied into an indoor space during the humidification operating mode, as a result of which arrangement the amount of heating applied by the regenerative heat exchanger (92) is reduced, thereby making it possible to effectively perform operations.

By way of example, the description has been made in which mixed air (RA+OA) composed of room air (RA) and outdoor air (OA) is used as cooling air in the first embodiment. However, the use of either room air (RA) or conditioned air (CA) as cooling air during the dehumidification operating mode enhances the cooling performance of the adsorption elements (81, 82) and therefore prevents the adsorption elements (81, 82) from deteriorating in their adsorption performance. Especially in the case where conditioned air (CA) is used as cooling air, the adsorption elements (81, 82) are cooled by air much lower in temperature than the room air (RA), whereby the cooling performance of the adsorption elements (81, 82) is improved to a further extent and it becomes possible to prevent, without fail, the drop in adsorption performance due to the generation of heat of adsorption during the adsorption operation.

Modification Example of First Embodiment

As the mixed air (RA+OA), air as result of mixing of room air (RA) and outdoor air (OA) at a predetermined mixing rate according to the temperature of the room air (RA) and the temperature of the outdoor air (OA) may be used. Cooling performance can be adjusted by varying the mixing rate of room air (RA) and outdoor air (OA). For example, in the case where outdoor air (OA) is used as cooling air and the cooling air is heated so that it serves as the regenerating air, cooling performance can be improved if the temperature of the cooling air is low, but on the other hand the COP falls due to the regenerative heating. On the contrary, if mixed air (RA+OA) composed of room air (RA) and outdoor air (OA) is used and the mixing rate is varied, this maintains a balance between the cooling performance and the regeneration efficiency.

In addition, as cooling air, mixed air as a result of mixing of room air (RA) and outdoor air (OA) at a predetermined mixing rate according to the temperature of the room air (RA) and the temperature of indoor supply air (SA) may be used. Also in this case, substantially the same effects as those obtained when the mixing rate is set based on the difference in temperature between the room air (RA) and the outdoor air (OA) are obtained.

Furthermore, as the cooling air, mixed air as a result of mixing of room air (RA) and outdoor air (OA) at a predetermined mixing rate according to the humidity of the room air (RA) and the humidity of the outdoor air (OA) may be used. In the case where cooling air is heated so that it serves as the regenerating air, regenerative performance falls if high-humidity air is used on the regenerative side. On the contrary, the aforesaid arrangement enables regeneration with humidity-controlled air, thereby making it possible to suppress the drop in regenerative performance.

Embodiment 2

An air conditioning apparatus according to a second embodiment of the present invention is provided with two adsorption elements (81, 82), performs a so-called batch operation, and is so constructed as to operate switchably between a dehumidification operating mode and a humidification operating mode. Such arrangements are the same as the first embodiment. The air conditioning apparatus of the present embodiment is able to perform, in addition to the dehumidification and humidification operating modes, an outside air cooling operating mode in which outdoor air (OA) taken inside is supplied indoors as it is. In addition, in the air conditioning apparatus of the present invention, switching between a first operation and a second operation is established with the adsorption elements (81, 82) fixed in position.

Figure 10:
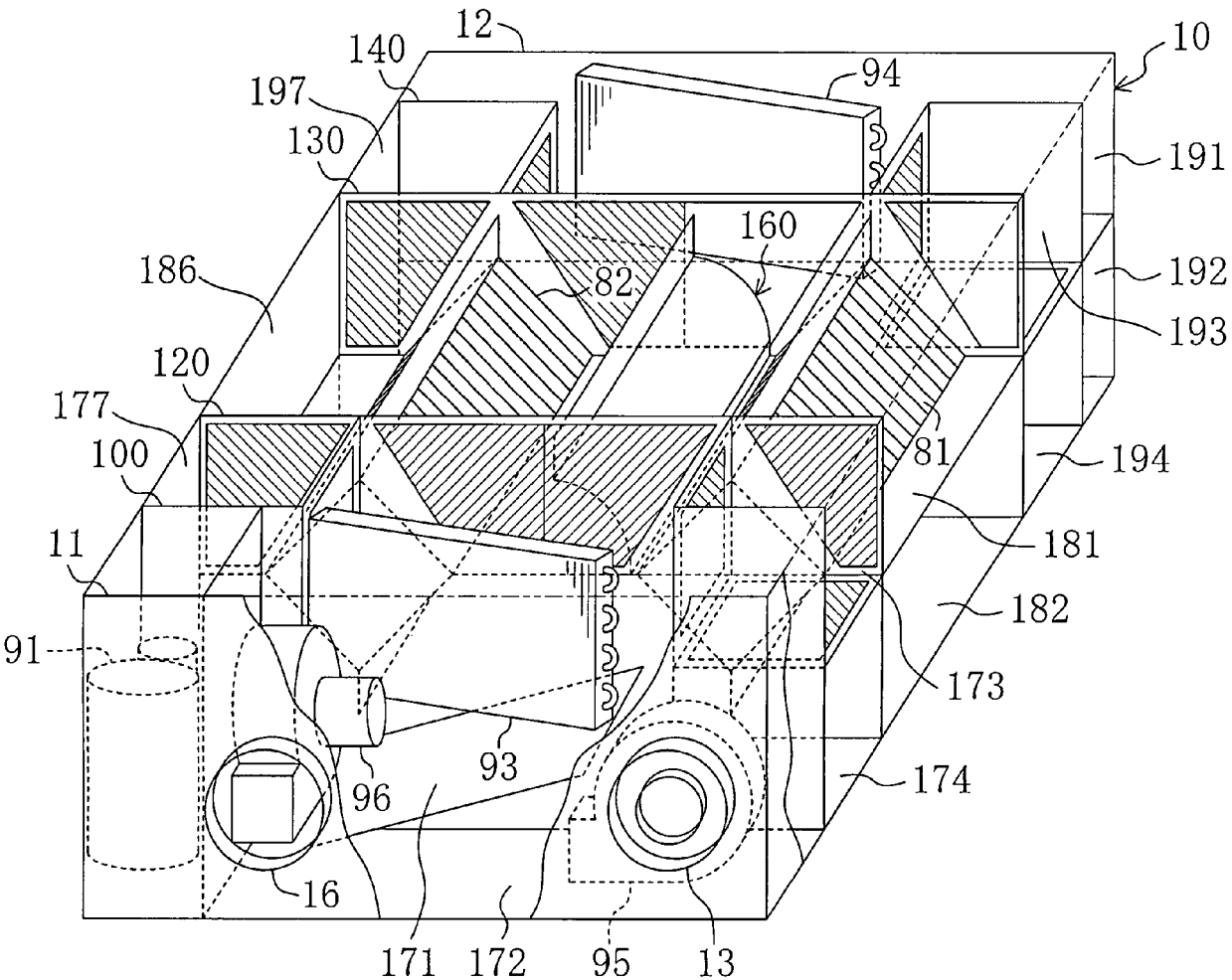
FIG. 10 is a schematic perspective view showing a constructional arrangement of an air conditioning apparatus according to a second embodiment of the present invention.
Figure 12:
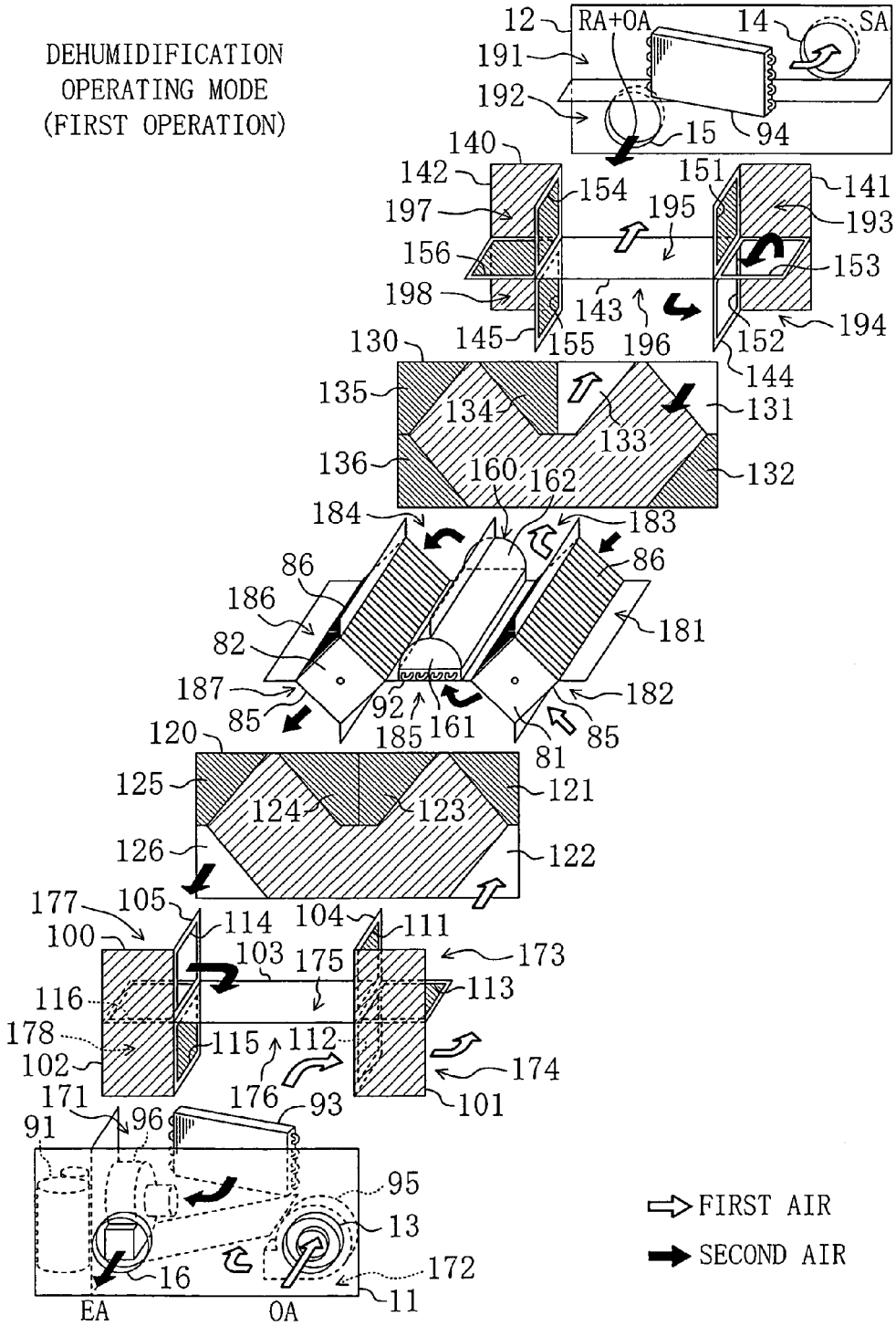
FIG. 12 is an exploded perspective view describing a first operation in a dehumidification operating mode of the air conditioning apparatus according to the second embodiment.

As shown in FIGS. 10 and 12, the air conditioning apparatus of the present embodiment has a somewhat flat, rectangular parallelepiped-shaped casing (10). The casing (10) houses, in addition to the two adsorption elements (81, 82), a single refrigerant circuit. These adsorption elements (81, 82) and the refrigerant circuit are similar in construction to their counterparts of the first embodiment.

As shown in FIGS. 10 and 12, the casing (10) is provided with an outdoor side panel (11) which is a nearest side panel, and an indoor side panel (12) which is a farthest side panel. An air supply side inlet (13) is formed to the right end of the outdoor side panel (11). An air discharge side outlet (16) is formed to the left end of the outdoor side panel (11). On the other hand, an air supply side outlet (14) is formed in an upper-right corner of the indoor side panel (12), and an air discharge side inlet (15) is formed in a lower-left corner of the indoor side panel (12).

First to fourth partition members (100, 120, 130, 140) are disposed sequentially from near to far side in the housing (10). The interior space of the casing (10) is partitioned front-to-rear by these partition panels (100, 120, 130, 140).

The space between the outdoor side panel (11) and the first partition member (100) is divided into an upper-situated, first upper flow path (171) and a lower-situated, first lower flow path (172). The first upper flow path (171) is brought into communication with an outdoor space by the air discharge side outlet (16). The first upper flow path (171) is provided with an air discharge fan (96) and a first cooling heat exchanger (93). The first lower flow path (172) is brought into communication with the outdoor space by the air supply side inlet (13). The first lower flow path (172) is provided with an air supply fan (95).

Of the space defined between the outdoor side panel (11) and the first partition member (100), an enclosed space to the left end serves as a machine room. The compressor (91) of the refrigerant circuit is disposed in the machine room.

The first partition member (100) is made up of a first right-front partition plate (101), a first left-front partition plate (102), a first right-side partition plate (104), a first left-side partition plate (105), and a first vertical partition plate (103).

Each of the first right-front partition plate (101) and the first left-front partition plate (102) is shaped like a vertically-elongated rectangle (longer than it is wide) having longer sides and shorter sides, wherein each longer side is substantially as long as the height of the casing (10) while each shorter side has a length of about one-fourth of the lateral width of the casing (10). The first right-front partition plate (101) is standingly arranged to the right of the casing (10) in such orientation that it runs parallel with the outdoor side panel (11). The first left-front partition plate (102) is standingly arranged to the left of the casing (10) in such orientation that it runs parallel with the outdoor side panel (11).

Each of the first right-side partition plate (104) and the first left-side partition plate (105) is shaped like a vertically-elongated rectangle having longer sides and shorter sides wherein each longer side is substantially as long as the height of the casing (10). A longer side of the first right-side partition plate (104) situated on the near side matches with a left-side longer side of the first right-front partition plate (101) and the first right-side partition plate (104) is standingly arranged so as to be oriented orthogonally to the first right-front partition plate (101). The first right-side partition plate (104) is provided, at its upper portion, a first upper-right opening (111) and is further provided, at its lower portion, a first lower-right opening (112). A longer side of the first left-side partition plate (105) situated on the near side matches with a right-side longer side of the first left-front partition plate (102) and the first left-side partition plate (105) is standingly arranged so as to be oriented orthogonally to the first left-front partition plate (102). The first left-side partition plate (105) is provided, at its upper portion, a first upper-left opening (114) and is further provided, at its lower portion, a first lower-left opening (115).

The first vertical partition plate (103) is shaped like a laterally-elongated rectangle (wider than it is long) having longer sides and shorter sides, wherein each longer side is substantially as long as the lateral width of the casing (10) while each shorter side is as long as the shorter sides of the first right- and left-side partition plates (104, 105). The first vertical partition plate (103) is so arranged as to be oriented orthogonally to each of the first right-front partition plate (101), the first left-front partition plate (102), the first right-side partition plate (104), and the first left-side partition plate (105). The first vertical partition plate (103) is disposed at a level corresponding to the middle of the height of the casing (10). Furthermore, the first vertical partition plate (103) is provided, at its portion situated on the right side of the first right-side partition plate (104), with a first right vertical opening (113) and is further provided, at its portion situated on the left side of the first left-side partition plate (105), with a first left vertical opening (116).

A second upper-right flow path (173), a second lower-right flow path (174), a second upper-central flow path (175), a second lower-central flow path (176), a second upper-left flow path (177), and a second lower-left flow path (178) are formed divisionally in the casing (10) by the first partition member (100). More specifically, on the right side of the first right-side partition plate (104), the second upper-right flow path (173) is formed above the first vertical partition plate (103) and the second lower-right flow path (174) is formed under the first vertical partition plate (103). Between the first right-side partition plate (104) and the first left-side partition plate (105), the second upper-central flow path (175) is formed above the first vertical partition palate (103) and the second lower-central flow path (176) is formed under the first vertical partition plate (103). On the left side of the first left-side partition plate (105), the second upper-left flow path (177) is formed above the first vertical partition plate (103) and the second lower-left flow path (178) is formed under the first vertical partition plate (103).

The second upper-right flow path (173) and the second upper-central flow path (175) are allowed to communicate with each other by the first upper-right opening (111). The second lower-right flow path (174) and the second lower-central flow path (176) are allowed to communicate with each other by the first lower-right opening (112). The second upper-right flow path (173) and the second lower-right flow path (174) are allowed to communicate with each other by the first right vertical opening (113). These openings (111, 112, 113) are opened and shut by respective opening/closing shutters which are switching mechanisms.

The second upper-left flow path (177) and the second upper-central flow path (175) are allowed to communicate with each other by the first upper-left opening (114). The second lower-left flow path (178) and the second lower-central flow path (176) are allowed to communicate with each other by the first lower-left opening (115). The second upper-left flow path (177) and the second lower-left flow path (178) are allowed to communicate with each other by the first left vertical opening (116). These openings (114, 115, 116) are opened and shut by respective opening/closing shutters which are switching mechanisms.

Neither the space between the second upper-central flow path (175) and the first upper flow path (171) nor the space between the second lower-central flow path (176) and the first lower flow path (172) is partitioned by the first partition member (100). Accordingly, the second upper-central flow path (175) constantly communicates with the first upper flow path (171) and the second lower-central flow path (176) constantly communicates with the first lower flow path (172).

The two adsorption elements (81, 82) are arranged side by side in a lateral row between the second partition member (120) and the third partition member (130). More specifically, the first adsorption element (81) is disposed to the right and the second adsorption element (82) is disposed to the left. These adsorption elements (81, 82) are arranged in parallel in such orientation that their respective longitudinal directions correspond to the longitudinal direction of the casing (10). In addition, as shown in FIG. 11, the adsorption elements (81, 82) are disposed in such orientation that their end surfaces each form a rhombic shape as a result of rotation of a square shape for an angle of 45 degrees. In other words, the adsorption elements (81, 82) are arranged in such orientation that one end-surface diagonal line of the adsorption element (81) is collinear with its corresponding end-surface diagonal line of the adsorption element (82).

Furthermore, the regenerative heat exchanger (92) of the refrigerant circuit and a switch shutter (160) are disposed between the second partition member (120) and the third partition member (130). The regenerative heat exchanger (92) is shaped like a flat plate. The rear-to-front length of the regenerative heat exchanger (92) is substantially the same as the rear-to-front length of the adsorption elements (81, 82). The regenerative heat exchanger (92) is disposed substantially horizontally between the first adsorption element (81) and the second adsorption element (82). Additionally, the regenerative heat exchanger (92) is disposed on a straight line that links together an end surface center of the first adsorption element (81) and an end surface center of the second adsorption element (82). And, air flows in a vertical direction through the regenerative heat exchanger (92).

The switch shutter (160), comprised of a shutter plate (162) and a pair of side plates (161), constitutes a switching mechanism. Each of the side plates (161) is shaped like a semicircular plate. The diameter of each side plate (161) is substantially the same as the right-to-left width of the regenerative heat exchanger (92). The side plates (161) are disposed along near- and far-side end surfaces of the regenerative heat exchanger (92), respectively. On the other hand, the shutter plate (162) extends from one of the side plates (161) to another side plate (161). The shutter plate (162) is shaped like a curved plate curving along a peripheral edge of each side plate (161). The center angle of the curved surface of the shutter plate (162) is 90 degrees. The shutter plate (162) covers a horizontal half portion of the regenerative heat exchanger (92). Furthermore, the shutter plate (162) is so constructed as to move along a peripheral edge of the side plate (161). And, the switch shutter (160) is switched between a first state in which the shutter plate (162) covers a right half portion of the regenerative heat exchanger (92) (see FIG. 11A) and a second state in which the shutter plate (162) covers a left half portion of the regenerative heat exchanger (92) (see FIG. 11B).

The space between the second partition member (120) and the third partition member (130) is divided into an upper space and a lower space. Each of the upper and lower spaces is divided, by the first and second adsorption elements (81, 82) and the switch shutter (160), into a left section and a right section. More specifically, divisionally formed on the right side of the first adsorption element (81) are an upper-situated, third upper-right flow path (181) and a lower-situated, third lower-right flow path (182). Divisionally formed above between the first adsorption element (81) and the second adsorption element (82) are a third central upper-right flow path (183) on the right side of the switch shutter (160) and a third central upper-left flow path (184) on the left side of the switch shutter (40). Divisionally formed below between the first adsorption element (81) and the second adsorption element (82) is a third lower-central flow path (185). Divisionally formed on the left side of the second adsorption element (82) are an upper-situated, third upper-left flow path (186) and a lower-situated, third lower-left flow path (187).

As has been described above, each adsorption element (81, 82) is provided with the humidity adjusting side passageway (85) and the cooling side passageway (86). And, the first adsorption element (81) is disposed in such orientation that the humidity adjusting side passageway (85) communicates with the third central upper-right flow path (183) as well as with the third lower-right flow path (182), and the cooling side passageway (86) communicates with the third upper-right flow path (181) as well as with the third lower-central flow path (185). On the other hand, the second adsorption element (82) is disposed in such orientation that the humidity adjusting side passageway (85) communicates with the third central upper-left flow path (184) as well as with the third lower-left flow path (187), and the cooling side passageway (86) communicates with the third upper-left flow path (186) as well as with the third lower-central flow path (185).

The second partition member (120) is provided with six openings. The second upper-right opening (121) which opens in an upper-right corner of the second partition member (120) allows the second upper-right flow path (173) and the third upper-right flow path (181) to communicate with each other. The second lower-right opening (122) which opens in a lower-right corner of the second partition member (120) allows the second lower-right flow path (174) and the third lower-right flow path (182) to communicate with each other. The second central right opening (123) which opens in an upper-central area of the second partition member (120) situated to the right allows the second upper-central flow path (175) and the third central upper-right flow path (183) to communicate with each other. The second central left opening (124) which opens in an upper-central area of the second partition member (120) situated to the left allows the second upper-central flow path (175) and the third central upper-left flow path (184) to communicate with each other. The second upper-left opening (125) which opens in an upper-left corner of the second partition member (120) allows the second upper-left flow path (177) and the third upper-left flow path (186) to communicate with each other. Finally, the second lower-left opening (126) which opens in a lower-left corner of the second partition member (120) allows the second lower-left flow path (178) and the third lower-left flow path (187) to communicate with each other. These openings (121, . . . ) are opened and shut by respective opening/closing shutters which are switching mechanisms.

The fourth partition member (140) is made up of a fourth right-rear partition plate (141), a fourth left-rear partition plate (142), a fourth right-side partition plate (144), a fourth left-side partition plate (145), and a fourth vertical partition plate (143).

Each of the fourth right-rear partition plate (141) and the fourth left-rear partition plate (142) is shaped like a vertically-elongated rectangle (longer than it is wide) having longer sides and shorter sides, wherein each longer side is substantially as long as the height of the casing (10) while each shorter side has a length of about one-fourth of the lateral width of the casing (10). The fourth right-rear partition plate (141) is standingly arranged to the right of the casing (10) in such orientation that it runs parallel with the indoor side panel (12). The fourth left-rear partition plate (142) is standingly arranged to the left of the casing (10) in such orientation that it runs parallel with the indoor side panel (12).

Each of the fourth right-side partition plate (144) and the fourth left-side partition plate (145) is shaped like a vertically-elongated rectangle having longer sides and shorter sides wherein each longer side is substantially as long as the height of the casing (10). A longer side of the first right-side partition plate (104) situated on the far side matches with a left-side longer side of the fourth right-rear partition plate (141) and the fourth right-side partition plate (144) is standingly arranged so as to be oriented orthogonally to the fourth right-rear partition plate (141). The fourth right-side partition plate (144) is provided, at its upper portion, a fourth upper-right opening (151) and is further provided, at its lower portion, a fourth lower-right opening (152).

A longer side of the fourth left-side partition plate (145) situated on the far side matches with a right-side longer side of the fourth left-rear partition plate (142) and the fourth left-side partition plate (145) is standingly arranged so as to be oriented orthogonally to the fourth left-rear partition plate (142). The fourth left-side partition plate (145) is provided, at its upper portion, a fourth upper-left opening (154) and is further provided, at its lower portion, a fourth lower-left opening (155).

The fourth vertical partition plate (143) is shaped like a laterally-elongated rectangle (wider than it is long) having longer sides and shorter sides, wherein each longer side is substantially as long as the lateral width of the casing (10) while each shorter side is as long as the shorter sides of the fourth right- and left-side partition plates (144, 145). The fourth vertical partition plate (143) is so arranged as to be oriented orthogonally to each of the fourth right-rear partition plate (141), the fourth left-rear partition plate (142), the fourth right-side partition plate (144), and the fourth left-side partition plate (145). In addition, the fourth vertical partition plate (143) is disposed at a level corresponding to the middle of the height of the casing (10).

Furthermore, the fourth vertical partition plate (143) is provided, at its portion situated on the right side of the fourth right-side partition plate (144), with a fourth right vertical opening (153) and is further provided, at its portion situated on the left side of the fourth left-side partition plate (145), with a fourth left vertical opening (156).

A fourth upper-right flow path (193), a fourth lower-right flow path (194), a fourth upper-central flow path (195), a fourth lower-central flow path (196), a fourth upper-left flow path (197), and a fourth lower-left flow path (198) are formed divisionally in the casing (10) by the fourth partition member (140). More specifically, on the right side of the fourth right-side partition plate (144), the fourth upper-right flow path (193) is formed above the fourth vertical partition plate (143) and the fourth lower-right flow path (194) is formed under the fourth vertical partition plate (143). Between the fourth right-side partition plate (144) and the fourth left-side partition plate (145), the fourth upper-central flow path (195) is formed above the fourth vertical partition palate (143) and the fourth lower-central flow path (196) is formed under the fourth vertical partition plate (143). On the left side of the fourth left-side partition plate (145), the fourth upper-left flow path (197) is formed above the fourth vertical partition plate (143) and the fourth lower-left flow path (198) is formed under the fourth vertical partition plate (143).

The fourth upper-right flow path (193) and the fourth upper-central flow path (195) are allowed to communicate with each other by the fourth upper-right opening (151). The fourth lower-right flow path (194) and the fourth lower-central flow path (196) are allowed to communicate with each other by the fourth lower-right opening (152). The fourth upper-right flow path (193) and the fourth lower-right flow path (194) are allowed to communicate with each other by the fourth right vertical opening (153). These openings (151, 152, 153) are opened and shut by respective opening/closing shutters which are switching mechanisms.

The fourth upper-left flow path (197) and the fourth upper-central flow path (195) are allowed to communicate with each other by the fourth upper-left opening (154). The fourth lower-left flow path (198) and the fourth lower-central flow path (196) are allowed to communicate with each other by the fourth lower-left opening (155). The fourth upper-left flow path (197) and the fourth lower-left flow path (198) are allowed to communicate with each other by the fourth left vertical opening (156). These openings (154, 155, 156) are opened and shut by respective opening/closing shutters which are switching mechanism.

The third partition member (130) is provided with the following six openings. The third upper-right opening (131) which opens in an upper-right corner of the third partition member (130) allows the third upper-right flow path (181) and the fourth upper-right flow path (193) to communicate with each other. The third lower-right opening (132) which opens in a lower-right corner of the third partition member (130) allows the third lower-right flow path (182) and the fourth lower-right flow path (194) to communicate with each other. The third central right opening (133) which opens in an upper-central portion of the third partition member (130) situated to the right allows the third central upper-right flow path (183) and the fourth upper-central flow path (195) to communicate with each other. The third central left opening (134) which opens in an upper-central portion of the third partition member (130) situated to the left allows the third central upper-left flow path (184) and the fourth upper-central flow path (195) to communicate with each other. The third upper-left opening (135) which opens in an upper-left corner of the third partition member (130) allows the third upper-left flow path (186) and the fourth upper-left flow path (197) to communicate with each other. Finally, the third lower-left opening (136) which opens in a lower-left corner of the third partition member (130) allows the third lower-left flow path (187) and the fourth lower-left flow path (198) to communicate with each other. These openings (151, . . . ) are opened and shut by respective opening/closing shutters which are switching mechanisms.

The space defined between the indoor side panel (12) and the fourth partition member (140) is divided into an upper-situated, fifth upper flow path (191) and a lower-situated, fifth lower flow path (192). The fifth upper flow path (191) is brought into communication with an indoor space by the air supply side outlet (14). The fifth upper flow path (191) is provided with a second cooling heat exchanger (94). On the other hand, the fifth lower flow path (192) is brought into communication with the indoor space by the air discharge side inlet (15).

Running Operation

The running operation of the above-described air conditioning apparatus will be described with reference to FIGS. 11–17. As described above, the air conditioning apparatus performs a dehumidification operating mode, a humidification operating mode, and an outside air cooling operating mode in switching manner. The outside air cooling operating mode is carried out when the temperature of outdoor air is lower than that of inside air (for example during the intermediate season).

Dehumidification Operating Mode

Also in the second embodiment, in the dehumidification operating mode, outdoor air (OA) is dehumidified and then is supplied indoors while heat of adsorption generated in the adsorption element (81, 82) when dehumidifying the outdoor air (OA) is collected by mixed air (RA+OA) which is a combination of room air (RA) and outdoor air (OA).

Figure 13:
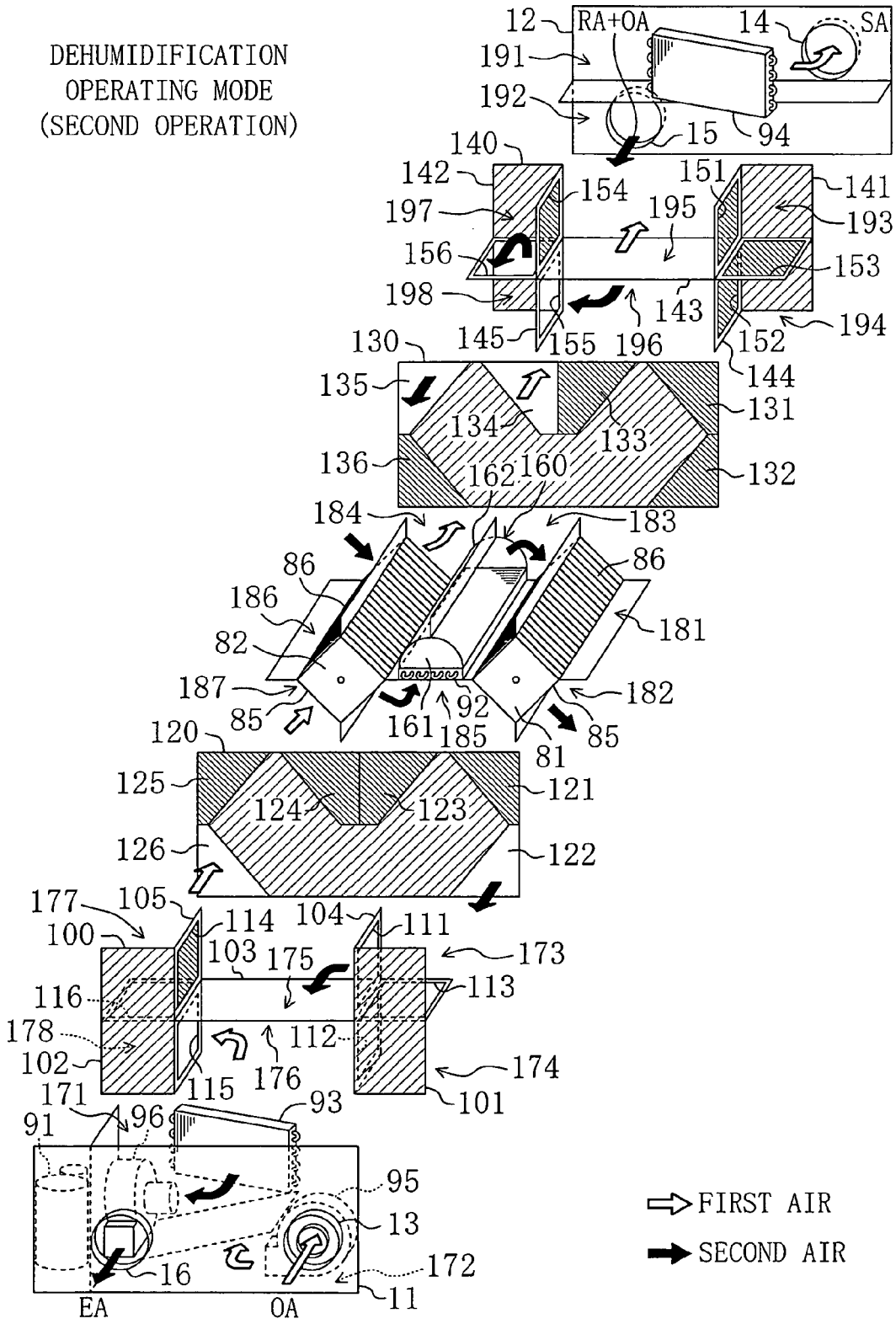
FIG. 13 is an exploded perspective view describing a second operation in the dehumidification operating mode of the air conditioning apparatus according to the second embodiment.

As shown in FIGS. 12 and 13, when the air supply fan (95) is activated in the dehumidification operating mode, outdoor air (OA) is taken into the inside of the casing (10) through the air supply side inlet (13). The outdoor air (OA) flows, as first air which constitutes adsorption air, into the first lower flow path (172). On the other hand, when the air discharge fan (96) is activated, mixed air (RA+OA) which is a combination of room air (RA) and outdoor air (OA) is taken into the inside of the casing (10) through the air discharge side inlet (15). The mixed air (RA+OA) flows, as second air which constitutes cooling air and regeneration air, into the fifth lower flow path (192).

Furthermore, during the dehumidification operating mode, refrigeration cycles are carried out in the refrigerant circuit, in which the regenerative heat exchanger (92) operates as a condenser and the second cooling heat exchanger (94) operates as an evaporator. Stated another way, no refrigerant flows in the first cooling heat exchanger (93) in the dehumidification operating mode. And, the dehumidification operating mode of the air conditioning apparatus is performed by repeating first and second operations in alternation.

Referring to FIGS. 11 and 12, the first operation of the dehumidification operating mode will be described. In the first operation, an adsorption operation and a cooling operation for the first adsorption element (81) are carried out while a regeneration operation for the second adsorption element (82) is carried out. Stated another way, during the first operation, air is dehumidified in the first adsorption element (81) simultaneously with regeneration of the adsorbent of the second adsorption element (82).

As shown in FIG. 12, in the first partition member (100), the first lower-right opening (112), the first upper-left opening (114), and the first left vertical opening (116) are placed in the communication state, while the rest of the openings (111, 113, 115) are placed in the shutoff state. In this state: the second lower-central flow path (176) and the second lower-right flow path (174) are brought into communication with each other by the first lower-right opening (112); the second upper-left flow path (177) and the second upper-central flow path (175) are brought into communication with each other by the first upper-left opening (114); and the second upper-left flow path (177) and the second lower-left flow path (178) are brought into communication with each other by the first left vertical opening (116).

In the second partition member (120), the second lower-right opening (122) and the second lower-left opening (126) are placed in the communication state, while the rest of the openings (121, 123, 124, 125) are placed in the shutoff state. In this state, the second lower-right flow path (174) and the third lower-right flow path (182) are brought into communication with each other by the second lower-right opening (122), and the second lower-left flow path (178) and the third lower-left flow path (187) are brought into communication with each other by the second lower-left opening (126).

In the switch shutter (160), the shutter plate (162) has moved to a position so that it covers a right half portion of the regenerative heat exchanger (92). In this state, the third lower-central flow path (185) and the third central upper-left flow path (184) are brought into communication with each other through the regenerative heat exchanger (92).

In the third partition member (130), the third upper-right opening (131) and the third central right opening (133) are placed in the communication state, while the rest of the openings (132, 134, 135, 136) are placed in the shutoff state. In this state, the third upper-right flow path (181) and the fourth upper-right flow path (193) are brought into communication with each other by the third upper-right opening (131) and the third central upper-right flow path (183) and the fourth upper-central flow path (195) are brought into communication with each other by the third central right opening (133).

In the fourth partition member (140), the fourth lower-right opening (152) and the fourth right vertical opening (153) are placed in the communication state, while the rest of the openings (151, 154, 155, 156) are placed in the shutoff state. In this state, the fourth lower-central flow path (196) and the fourth lower-right flow path (194) are brought into communication with each other by the fourth lower-right opening (152) and the fourth lower-right flow path (194) and the fourth upper-right flow path (193) are brought into communication with each other by the fourth right vertical opening (153).

The first air, taken into the casing (10), flows through the first lower flow path (172), the second lower-central flow path (176), and the second lower-right flow path (174) in that order, passes through the second lower-right opening (122), and flows into the third lower-right flow path (182). On the other hand, the second air, taken into the casing (10), flows through the fifth lower flow path (192), the fourth lower-central flow path (196), the fourth lower-right flow path (194), and the fourth upper-right flow path (193) in that order, passes through the third upper-right opening (131), and flows into the third upper-right flow path (181).

Figure 11A:
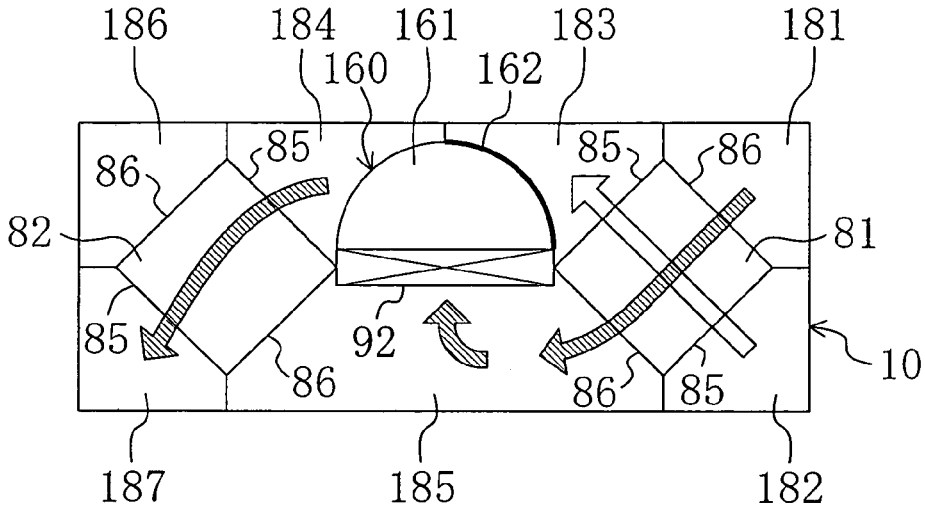
FIG. 11 is a diagram schematically showing principal parts of the air conditioning apparatus according to the second embodiment.

As also shown in FIG. 11A, the first air of the third lower-right flow path (182) flows, as adsorption air, into the humidity adjusting side passageway (85) of the first adsorption element (81). During the flow through the humidity adjusting side passageway (85), water vapor contained in the first air is adsorbed onto the adsorbent. The first air dehumidified in the first adsorption element (81) flows into the third central upper-right flow path (183).

On the other hand, the second air of the third upper-right flow path (181) flows into the cooling side passageway (86) of the first adsorption element (81). During the flow through the cooling side passageway (86), the second air absorbs heat of adsorption generated when water vapor was adsorbed onto the adsorbent in the humidity adjusting side passageway (85). In other words, the second air flows, as cooling air, through the cooling side passageway (86). The second air, which has robbed the heat of adsorption, flows into the third lower-central flow path (185). The second air of the third lower-central flow path (185) flows, after passing through the regenerative heat exchanger (92), into the third central upper-left flow path (184). At that time, in the regenerative heat exchanger (92), the second air is subjected to heat exchange with refrigerant and absorbs heat of condensation of the refrigerant.

The second air heated in the first adsorption element (81) and the regenerative beat exchanger (92) is introduced, as regeneration air, into the humidity adjusting side passageway (85) of the second adsorption element (82). In the humidity adjusting side passageway (85), the adsorbent is heated by the second air and, as a result, water vapor is desorbed from the adsorbent. In other words, the second adsorption element (82) is regenerated. Then, the water vapor desorbed from the adsorbent flows, together with the second air, into the third lower-left flow path (187).

As shown in FIG. 12, the first air after dehumidification, which has flowed into the third central upper-right flow path (183), flows into the fourth upper-central flow path (195) through the third central right opening (133) and then is delivered to the fifth upper flow path (191). During the flow through the fifth upper flow path (191), the first air passes through the second cooling heat exchanger (94). In the second cooling heat exchanger (94), the first air is subjected to heat exchange with refrigerant and liberates heat to the refrigerant. And, the first air dehumidified and cooled passes through the air supply side outlet (14) for supply to an indoor space.

On the other hand, the second air, which has flowed into the third lower-left flow path (187), flows through the second lower-left flow path (178), the second upper-left flow path (177), and the second upper-central flow path (175) in that order and thereafter flows into the first upper flow path (171). During the flow through the first upper flow path (171), the second air passes through the first cooling heat exchanger (93). At this time, no refrigerant is flowing through the first cooling heat exchanger (93). Therefore, the second air just passes through the first cooling heat exchanger (93), in other words, the second air neither absorbs nor liberates heat. And, the second air, which was used for cooling of the first adsorption element (81) as well as for regeneration of the second adsorption element (82), is discharged outdoors through the air discharge side outlet (16).

Referring to FIGS. 11 and 13, the second operation of the dehumidification operating mode will be described. In the second operation, on the contrary to the first operation, air is dehumidified in the second adsorption element (82) simultaneously with regeneration of the absorbent of the first adsorption element (81).

As shown in FIG. 13, in the first partition member (100), the first upper-right opening (111), the first right vertical opening (113), and the first lower-left opening (115) are placed in the communication state, while the rest of the openings (112, 114, 116) are placed in the shutoff state. In this state: the second upper-central flow path (175) and the second upper-right flow path (173) are brought into communication with each other by the first upper-right opening (111); the second upper-right flow path (173) and the second lower-right flow path (174) are brought into communication with each other by the first right vertical opening (113); and the second lower-left flow path (178) and the second lower-central flow path (176) are brought into communication with each other by the first lower-left opening (115).

In the second partition member (120), the second lower-right opening (122) and the second lower-left opening (126) are placed in the communication state, while the rest of the openings (121, 123, 124, 125) are placed in the shutoff state. In this state, the second lower-right flow path (174) and the third lower-right flow path (182) are brought into communication with each other by the second lower-right opening (122) and the second lower-left flow path (178) and the third lower-left flow path (187) are brought into communication with each other by the second lower-left opening (126).

In the switch shutter (160), the shutter plate (162) has moved to a position so that it covers a left half portion of the regenerative heat exchanger (92). In this state, the third lower-central flow path (185) and the third central upper-right flow path (183) are brought into communication with each other through the regenerative heat exchanger (92).

In the third partition member (130), the third upper-left opening (135) and the third central left opening (134) are placed in the communication state, while the rest of the openings (131, 132, 133, 136) are placed in the shutoff state. In this state, the third upper-left flow path (186) and the fourth upper-left flow path (197) are brought into communication with each other by the third upper-left opening (135) and the third central upper-left flow path (184) and the fourth upper-central flow path (195) are brought into communication with each other by the third central left opening (134).

In the fourth partition member (140), the fourth lower-left opening (155) and the fourth left vertical opening (156) are placed in the communication state, while the rest of the openings (151, 152, 153, 154) are placed in the shutoff state. In this state, the fourth lower-central flow path (196) and the fourth lower-left flow path (198) are brought into communication with each other by the fourth lower-left opening (155) and the fourth lower-left flow path (198) and the fourth upper-left flow path (197) are brought into communication with each other by the fourth left vertical opening (156).

The first air, taken into the casing (10), flows through the first lower flow path (172), the second lower-central flow path (176), and the second lower-left flow path (178) in that order, passes through the second lower-left opening (126), and flows into the third lower-left flow path (187). On the other hand, the second air, taken into the casing (10), flows through the fifth lower flow path (192), the fourth lower-central flow path (196), the fourth lower-left flow path (198), and the fourth upper-left flow path (197) in that order, passes through the third upper-left opening (135), and flows into the third upper-left flow path (186).

Figure 11B:
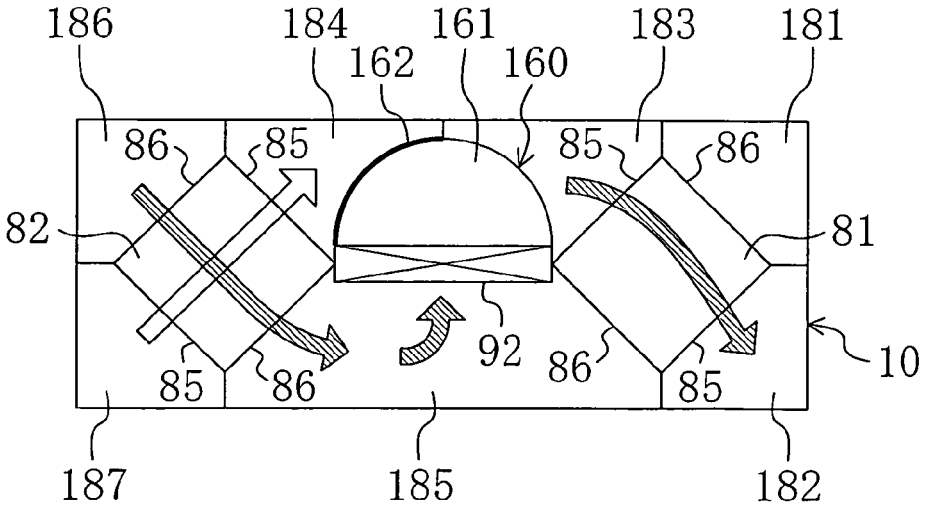

As also shown in FIG. 11B, the first air of the third lower-left flow path (187) flows, as adsorption air, into the humidity adjusting side passageway (85) of the second adsorption element (82). During the flow through the humidity adjusting side passageway (85), water vapor contained in the first air is adsorbed onto the adsorbent. The first air dehumidified by the second adsorption element (82) flows into the third central upper-left flow path (184).

On the other hand, the second air of the third upper-left flow path (186) flows into the cooling side passageway (86) of the second adsorption element (82). During the flow through the cooling side passageway (86), the second air absorbs heat of adsorption generated when the water vapor was adsorbed onto the adsorbent in the humidity adjusting side passageway (85). In other words, the second air flows, as cooling air, through the cooling side passageway (86). The second air, which has robbed the heat of adsorption, flows into the third lower-central flow path (185). The second air of the third lower-central flow path (185) flows, after passing through the regenerative heat exchanger (92), into the third central upper-right flow path (183). At that time, in the regenerative heat exchanger (92), the second air is subjected to heat exchange with refrigerant and absorbs heat of condensation of the refrigerant.

The second air heated in the second adsorption element (82) and the regenerative heat exchanger (92) is introduced into the humidity adjusting side passageway (85) of the first adsorption element (81). In the humidity adjusting side passageway (85), the adsorbent is heated by the second air and, as a result, water vapor is desorbed from the adsorbent. In other words, the first adsorption element (81) is regenerated. Then, the water vapor desorbed from the adsorbent flows, together with the second air, into the third lower-right flow path (182).

As shown in FIG. 13, the first air after dehumidification, which has flowed into the third central upper-left flow path (184), flows into the fourth upper-central flow path (195) through the third central left opening (134) and then is delivered to the fifth upper flow path (191). During the flow through the fifth upper flow path (191), the first air passes through the second cooling heat exchanger (94). In the second cooling heat exchanger (94), the first air is subjected to heat exchange with refrigerant and liberates heat to the refrigerant. And, the first air dehumidified and cooled passes through the air supply side outlet (14) and is supplied indoors.

On the other hand, the second air, which has flowed into the third lower-right flow path (182), flows through the second lower-right flow path (174), the second upper-right flow path (173), and the second upper-central flow path (175) in that order and thereafter flows into the first upper flow path (171). During the flow through the first upper flow path (171), the second air passes through the first cooling heat exchanger (93). At this time, no refrigerant is flowing through the first cooling heat exchanger (93). Therefore, the second air just passes through the first cooling heat exchanger (93), in other words, the second air neither absorbs nor liberates heat. And, the second air used for cooling of the first adsorption element (81) as well as for regeneration of the second adsorption element (82) is discharged outdoors through the air discharge side outlet (16).

As has been described above, during the first operation, adsorption and cooling for the first adsorption element (81) are carried out while regeneration for the second adsorption element (82) is carried out. On the other hand, during the second operation, regeneration for the first adsorption element (81) is carried out while adsorption and cooling for the second adsorption element (82) are carried out. At that time, heat of adsorption generated in the humidity adjusting side passageway (85) of each of the adsorption elements (81, 82) is collected by the second air flowing through the cooling side passageway (86). Because of this, the adsorption element (81, 82) is cooled by the second air, thereby suppressing the temperature rise of the adsorption element (81, 82).

Humidification Operating Mode

Figure 14:
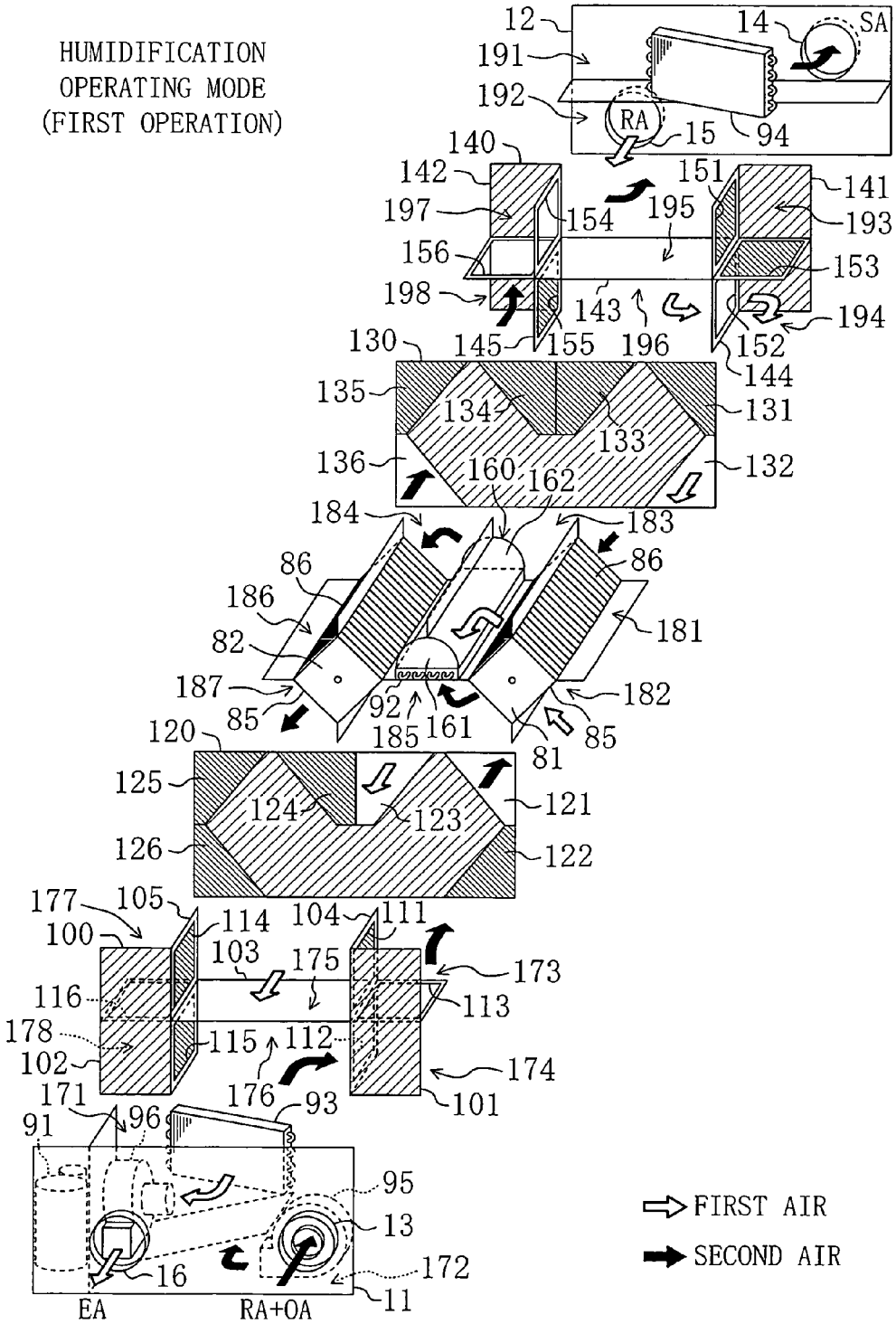
FIG. 14 is an exploded perspective view describing a first operation in a humidification operating mode of the air conditioning apparatus according to the second embodiment.
Figure 15:
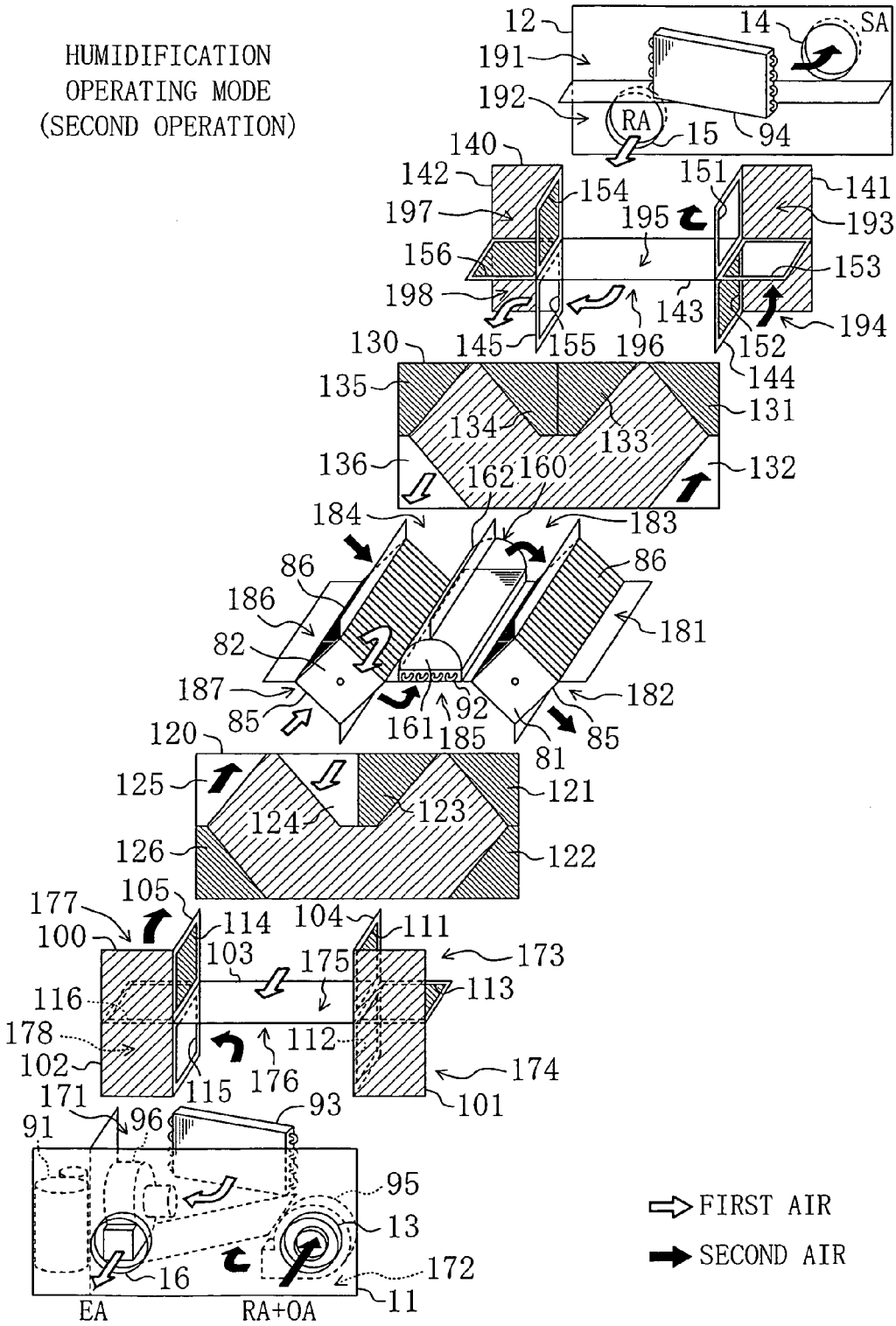
FIG. 15 is an exploded perspective view describing a second operation in the humidification operating mode of the air conditioning apparatus according to the second embodiment.

As shown in FIGS. 14 and 15, when the air supply fan (95) is activated in the humidification operating mode, mixed air (RA+OA), i.e., a combination of room air (RA) and outdoor air (OA), is taken into the inside of the casing (10) through the air supply side inlet (13). The mixed air (RA+OA) flows, as second air which constitutes cooling air and regeneration air, into the first lower flow path (172). On the other hand, when the air discharge fan (96) is activated, room air (OA) is taken into the inside of the casing (10) through the air discharge side inlet (15). The room air (RA) flows, as first air which constitutes adsorption air, into the fifth lower flow path (192).

Furthermore, in the humidification operating mode, refrigeration cycles are carried out in the refrigerant circuit, in which the regenerative heat exchanger (92) operates as a condenser and the first cooling heat exchanger (93) operates as an evaporator. Stated another way, no refrigerant flows in the second cooling heat exchanger (94) in the humidification operating mode. And, the humidification operating mode of the air conditioning apparatus is performed by repeating first and second operations in alternation.

Referring to FIGS. 11 and 14, the first operation of the humidification operating mode will be described. In the first operation, an adsorption operation and a cooling operation for the first adsorption element (81) are carried out while a regeneration operation for the second adsorption element (82) is carried out. In other words, in the first operation, air is humidified in the second adsorption element (82) and the adsorbent of the first adsorption element (81) adsorbs water vapor.

As shown in FIG. 14, in the first partition member (100), the first lower-right opening (112) and the first right vertical opening (113) are placed in the communication state, while the rest of the openings (111, 114, 115, 116) are placed in the shutoff state. In this state, the second lower-central flow path (176) and the second lower-right flow path (174) are brought into communication with each other by the first lower-right opening (112) and the second upper-right flow path (173) and the second lower-right flow path (174) are brought into communication with each other by the first right vertical opening (113).

In the second partition member (120), the second upper-right opening (121) and the second central right opening (123) are placed in the communication state, while the rest of the openings (122, 124, 125, 126) are placed in the shutoff state. In this state, the second upper-right flow path (173) and the third upper-right flow path (181) are brought into communication with each other by the second upper-right opening (121) and the second upper-central flow path (175) and the third central upper-right flow path (183) are brought into communication with each other by the second central right opening (123).

In the switch shutter (160), the shutter plate (162) has moved to a position so that it covers a right half portion of the regenerative heat exchanger (92). In this state, the third lower-central flow path (185) and the third central upper-left flow path (184) are brought into communication with each other through the regenerative heat exchanger (92).

In the third partition member (130), the third lower-right opening (132) and the third lower-left opening (136) are placed in the communication state, while the rest of the openings (131, 133, 134, 135) are placed in the shutoff state. In this state, the third lower-right flow path (182) and the fourth lower-right flow path (194) are brought into communication with each other by the third lower-right opening (132) and the third lower-left flow path (187) and the fourth lower-left flow path (198) are brought into communication with each other by the third lower-left opening (136).

In the fourth partition member (140), the fourth lower-right opening (152), the fourth upper-left opening (154), and the fourth left vertical opening (156) are placed in the communication state, while the rest of the openings (151, 153, 155) are placed in the shutoff state. In this state: the fourth lower-central flow path (196) and the fourth lower-right flow path (194) are brought into communication with each other by the fourth lower-right opening (152); the fourth upper-central flow path (195) and the fourth upper-left flow path (197) are brought into communication with each other by the fourth upper-left opening (154); and the fourth lower-left flow path (198) and the fourth upper-left flow path (197) are brought into communication with each other by the fourth left vertical opening (156).

The first air, taken into the casing (10), flows through the fifth lower flow path (192), the fourth lower-central flow path (196), and the fourth lower-right flow path (194) in that order, passes through the third lower-right opening (132), and flows into the third lower-right flow path (182). On the other hand, the second air, taken into the casing (10), flows through the first lower flow path (172), the second lower-central flow path (176), the second lower-right flow path (174), and the second upper-right flow path (173) in that order, passes through the second upper-right opening (121), and flows into the third upper-right flow path (181).

As also shown in FIG. 11A, the first air of the third lower-right flow path (182) flows, as adsorption air, into the humidity adjusting side passageway (85) of the first adsorption element (81). During the flow through the humidity adjusting side passageway (85), water vapor contained in the first air is adsorbed onto the adsorbent. The first air dehumidified in the first adsorption element (81) flows into the third central upper-right flow path (183).

On the other hand, the second air of the third upper-right flow path (181) flows into the cooling side passageway (86) of the first adsorption element (81). During the flow through the cooling side passageway (86), the second air absorbs heat of adsorption generated when the water vapor was adsorbed onto the adsorbent in the humidity adjusting side passageway (85). In other words, the second air flows, as cooling air, through the cooling side passageway (86). The second air, which has robbed the heat of adsorption, flows into the third lower-central flow path (185). The second air of the third lower-central flow path (185) flows, after passing through the regenerative heat exchanger (92), into the third central upper-left flow path (184). At that time, in the regenerative heat exchanger (92), the second air is subjected to heat exchange with refrigerant and absorbs heat of condensation of the refrigerant.

The second air heated in the first adsorption element (81) and the regenerative heat exchanger (92) is introduced, as regeneration air, into the humidity adjusting side passageway (85) of the second adsorption element (82). In the humidity adjusting side passageway (85), the adsorbent is heated by the second air and, as a result, water vapor is desorbed from the adsorbent. In other words, the second adsorption element (82) is regenerated. Then, the water vapor desorbed from the adsorbent is given to the second air, as a result of which the second air is humidified. The second air humidified in the second adsorption element (82) flows into the third lower-left flow path (187).

As shown in FIG. 14, the second air after humidification, which has flowed into the third lower-left flow path (187), flows through the fourth lower-left flow path (198), the fourth upper-left flow path (197), and the fourth upper-central flow path (195) in that order and thereafter flows into the fifth upper flow path (191). During the flow through the fifth upper flow path (191), the second air passes through the second cooling heat exchanger (94). At this time, no refrigerant is flowing through the second cooling heat exchanger (94). Therefore, the second air just passes through the second cooling heat exchanger (94), in other words, the second air neither absorbs nor liberates heat. And, the second air heated and humidified is supplied indoors through the air supply side outlet (14).

On the other hand, the first air after dehumidification, which has flowed into the third central upper-right flow path (183), passes through the second upper-central flow path (175), and flows into the first upper flow path (171). During the flow through the first upper flow path (171), the first air passes through the first cooling heat exchanger (93). In the first cooling heat exchanger (93), the first air is subjected to heat exchange with refrigerant and liberates heat to the refrigerant. And, the dehumidified, heat-robbed first air is discharged outdoors through the air discharge side outlet (16).

Referring to FIGS. 11 and 15, the second operation of the humidification operating mode will be described. In the second operation, adsorption and cooling for the second adsorption element (82) are carried out while regeneration for the first adsorption element (81) is carried out. In other words, in the second operation, air is humidified in the first adsorption element (81) and the absorbent of the second adsorption element (82) adsorbs water vapor.

As shown in FIG. 15, in the first partition member (100), the first lower-left opening (115) and the first left vertical opening (116) are placed in the communication state, while the rest of the openings (111, 112, 113, 114) are placed in the shutoff state. In this state, the second lower-central flow path (176) and the second lower-left flow path (178) are brought into communication with each other by the first lower-left opening (115) and the second upper-left flow path (177) and the second lower-left flow path (178) are brought into communication with each other by the first left vertical opening (116).

In the second partition member (120), the second upper-left opening (125) and the second central left opening (124) are placed in the communication state, while the rest of the openings (121, 122, 123, 126) are placed in the shutoff state. In this state, the second upper-left flow path (177) and the third upper-left flow path (186) are brought into communication with each other by the second upper-left opening (125) and the second upper-central flow path (175) and the third central upper-left flow path (184) are brought into communication with each other by the second central left opening (124).

In the switch shutter (160), the shutter plate (162) has moved to a position so that it covers a left half portion of the regenerative heat exchanger (92). In this state, the third lower-central flow path (185) and the third central upper-right flow path (183) are brought into communication with each other through the regenerative heat exchanger (92).

In the third partition member (130), the third lower-right opening (132) and the third lower-left opening (136) are placed in the communication state, while the rest of the openings (131, 133, 134, 135) are placed in the shutoff state. In this state, the third lower-right flow path (182) and the fourth lower-right flow path (194) are brought into communication with each other by the third lower-right opening (132) and the third lower-left flow path (187) and the fourth lower-left flow path (198) are brought into communication with each other by the third lower-left opening (136).

In the fourth partition member (140), the fourth upper-right opening (151), the fourth right vertical opening (153), and the fourth lower-left opening (155) are placed in the communication state, while the rest of the openings (152, 154, 156) are placed in the shutoff state. In this state: the fourth upper-right flow path (193) and the fourth upper-central flow path (195) are brought into communication with each other by the fourth upper-right opening (151); the fourth lower-right flow path (194) and the fourth upper-right flow path (193) are brought into communication with each other by the fourth right vertical opening (153); and the fourth lower-central flow path (196) and the fourth lower-left flow path (198) are brought into communication with each other by the fourth lower-left opening (155).

The first air, taken into the casing (10), flows through the fifth lower flow path (192), the fourth lower-central flow path (196), and the fourth lower-left flow path (198) in that order, passes through the third lower-left opening (136), and flows into the third lower-left flow path (187). On the other hand, the second air, taken into the casing (10), flows through the first lower flow path (172), the second lower-central flow path (176), the second lower-left flow path (178), and the second upper-left flow path (177) in that order, passes through the second upper-left opening (125), and flows into the third upper-left flow path (186).

As also shown in FIG. 11B, the first air of the third lower-left flow path (187) flows, as adsorption air, into the humidity adjusting side passageway (85) of the second adsorption element (82). During the flow through the humidity adjusting side passageway (85), water vapor contained in the first air is adsorbed onto the adsorbent. The first air dehumidified in the second adsorption element (82) flows into the third central upper-left flow path (184).

On the other hand, the second air of the third upper-left flow path (186) flows into the cooling side passageway (86) of the second adsorption element (82). During the flow through the cooling side passageway (86), the second air absorbs heat of adsorption generated when the water vapor was adsorbed onto the adsorbent in the humidity adjusting side passageway (85). In other words, the second air flows, as cooling air, through the cooling side passageway (86). The second air, which has robbed the heat of adsorption, flows into the third lower-central flow path (185). The second air of the third lower-central flow path (185) flows, after passing through the regenerative heat exchanger (92), into the third central upper-right flow path (183). At that time, in the regenerative heat exchanger (92), the second air is subjected to heat exchange with refrigerant and absorbs heat of condensation of the refrigerant.

The second air heated in the second adsorption element (82) and the regenerative heat exchanger (92) is introduced, as regeneration air, into the humidity adjusting side passageway (85) of the first adsorption element (81). In the humidity adjusting side passageway (85), the adsorbent is heated by the second air and, as a result, water vapor is desorbed from the adsorbent. In other words, the first adsorption element (81) is regenerated. Then, the water vapor desorbed from the adsorbent is given to the second air and, as a result, the second air is humidified. Thereafter, the second air humidified in the first adsorption element (81) flows into the third lower-right flow path (182).

As shown in FIG. 15, the second air after humidification, which has flowed into the third lower-right flow path (182), flows into the fourth lower-right flow path (194), the fourth upper-right flow path (193), and the fourth upper-central flow path (195) in that order and thereafter flows into the fifth upper flow path (191). During the flow through the fifth upper flow path (191), the second air passes through the second cooling heat exchanger (94). At this time, no refrigerant is flowing through the second cooling heat exchanger (94). Therefore, the second air just passes through the second cooling heat exchanger (94), in other words, the second air neither absorbs nor liberates heat. And, the second air heated and humidified is supplied indoors through the air supply side outlet (14).

On the other hand, the first air dehumidified, which has flowed into the third central upper-left flow path (184), passes through the second upper-central flow path (175) and flows into the first upper flow path (171). During the flow through the first upper flow path (171), the first air passes through the first cooling heat exchanger (93). In the first cooling heat exchanger (93), the first air is subjected to heat exchange with refrigerant and liberates heat to the refrigerant. And, the dehumidified and heat-robbed first air is discharged outdoors through the air discharge side outlet (16).

As described above, during the first operation, adsorption and cooling for the first adsorption element (81) are carries out while regeneration for the second adsorption element (82) is carried out. On the other hand, during the second operation, regeneration for the first adsorption element (81) is carried out while adsorption and cooling for the second adsorption element (82) are carried out. At that time, heat of adsorption generated in the humidity adjusting side passageway (85) of each adsorption element (81, 82) is collected by the second air flowing through the cooling side passageway (86). Because of this, the adsorption element (81, 82) is cooled by the second air, thereby suppressing the temperature rise of the adsorption element (81, 82).

Outside Air Cooling Operating Mode

During the outside air cooling operating mode, outdoor air (OA), taken into the casing (10), is supplied indoors without passing through the adsorption element (81) or the adsorption element (82), while room air (RA), taken into the casing (10), is discharged outdoors without passing through the adsorption element (81) or the adsorption element (82). In addition, the compressor (91) of the refrigerant circuit is at a stop and no refrigeration cycle is carried out.

Figure 16:
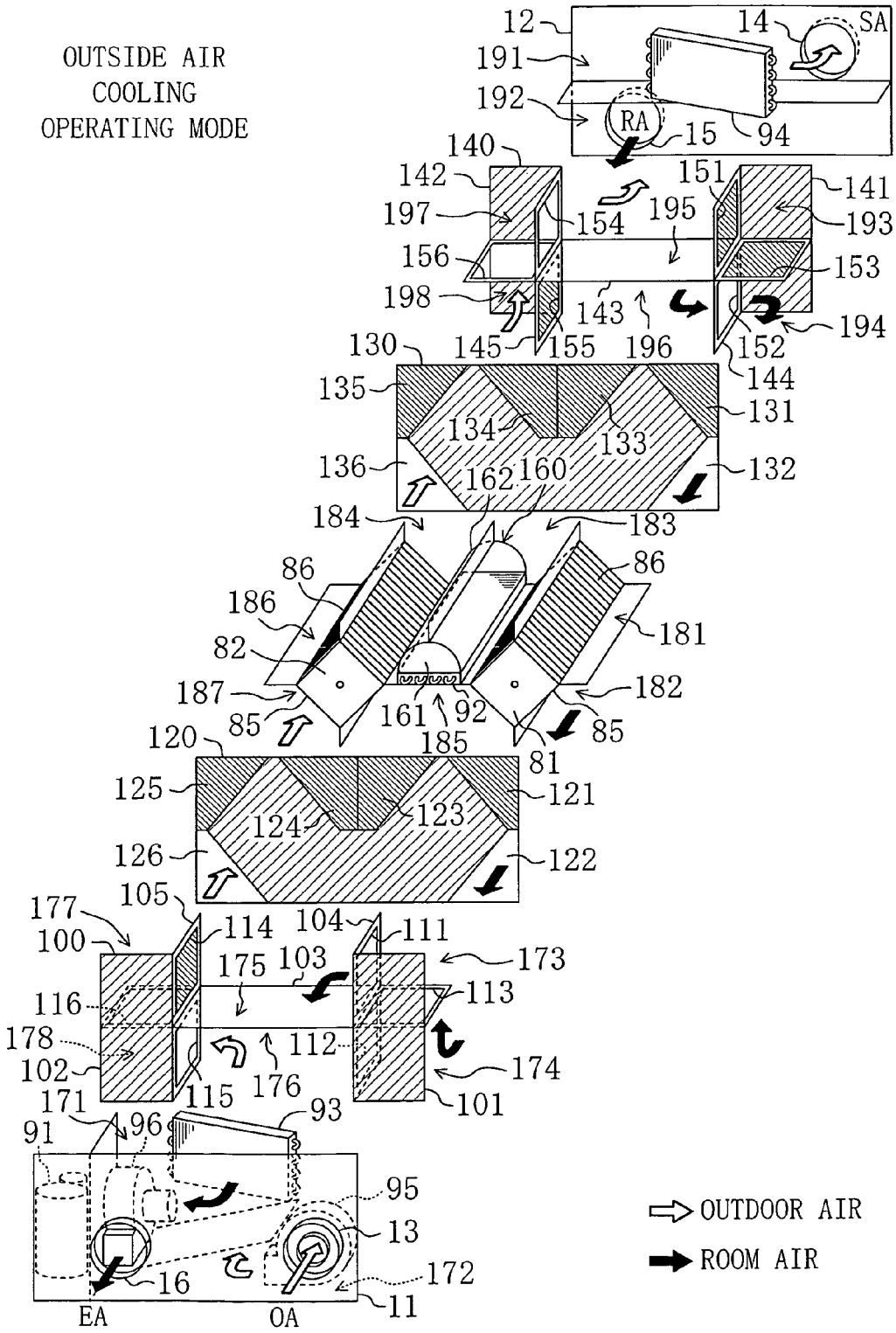
FIG. 16 is an exploded perspective view describing operations in an outside air cooling operating mode of the air conditioning apparatus according to the second embodiment.

Referring to FIG. 16, the outside air cooling operating mode will be described. Although in FIG. 16 the shutter plate (162) of the switch shutter (160) is in such a state that it covers a left half portion of the regenerative heat exchanger (92), the state of the switch shutter (160) can be disregarded.

In the first partition member (100), the first upper-right opening (111), the first right vertical opening (113), and the first lower-left opening (115) are placed in the communication state, while the rest of the openings (112, 114, 116) are placed in the shutoff state. In this state: the second upper-central flow path (175) and the second upper-right flow path (173) are brought into communication with each other by the first upper-right opening (111); the second upper-right flow path (173) and the second lower-right flow path (174) are brought into communication with each other by the first right vertical opening (113); and the second lower-left flow path (178) and the second lower-central flow path (176) are brought into communication with each other by the first lower-left opening (115).

In the second partition member (120), the second lower-right opening (122) and the second lower-left opening (126) are placed in the communication state, while the rest of the openings (121, 123, 124, 125) are placed in the shutoff state. In this state, the second lower-right flow path (174) and the third lower-right flow path (182) are brought into communication with each other by the second lower-right opening (122) and the second lower-left flow path (178) and the third lower-left flow path (187) are brought into communication with each other by the second lower-left opening (126).

In the third partition member (130), the third lower-right opening (132) and the third lower-left opening (136) are placed in the communication state, while the rest of the openings (131, 133, 134, 135) are placed in the shutoff state. In this state, the third lower-right flow path (182) and the fourth lower-right flow path (194) are brought into communication with each other by the third lower-right opening (132) and the third lower-left flow path (187) and the fourth lower-left flow path (198) are brought into communication with each other by the third lower-left opening (136).

In the fourth partition member (140), the fourth lower-right opening (152), the fourth upper-left opening (154), and the fourth left vertical opening (156) are placed in the communication state, while the rest of the openings (151, 153, 155) are placed in the shutoff state. In this state: the fourth lower-central flow path (196) and the fourth lower-right flow path (194) are brought into communication with each other by the fourth lower-right opening (152); the fourth upper-central flow path (195) and the fourth upper-left flow path (197) are brought into communication with each other by the fourth upper-left opening (154); and the fourth lower-left flow path (198) and the fourth upper-left flow path (197) are brought into communication with each other by the fourth left vertical opening (156).

When the air supply fan (95) is activated, outdoor air (OA) is taken into the casing (10) through the air supply side inlet (13). Thereafter, the outdoor air (OA) flows through the first lower flow path (172), the second lower-central flow path (176), the second lower-left flow path (178), the third lower-left flow path (187), the fourth lower-left flow path (198), the fourth upper-left flow path (197), the fourth upper-central flow path (195), and the fifth upper flow path (191) in that order, and is supplied indoors.

On the other hand, when the air discharge fan (96) is activated, room air (RA) is taken into the casing (10) through the air discharge side inlet (15). Thereafter, the room air (RA) flows through the fifth lower flow path (192), the fourth lower-central flow path (196), the fourth lower-right flow path (194), the third lower-right flow path (182), the second lower-right flow path (174), the second upper-right flow path (173), the second upper-central flow path (175), and the first upper flow path (171) in that order, and is discharged outdoors through the air discharge side outlet (16).

Effects of Second Embodiment

Also, in the second embodiment, heat of adsorption, generated in the humidity adjusting side passageway (85) of each of the first and second adsorption elements (81, 82) when dehumidifying the first air, is collected by mixed air (RA+OA) as second air which is a combination of room air (RA) and outdoor air (OA), for cooling each adsorption element (81, 82). As a result of such arrangement, even when the outside temperature is high during the dehumidification operating mode, it becomes possible to suppress the temperature rise of the adsorption element (81, 82) by making utilization of mixed air (RA+OA) lower in temperature than outdoor air (OA). Because of this, the drop in adsorption performance of the adsorption elements (81, 82) is suppressed in comparison with the conventional apparatuses, and the amount of moisture adsorbable by the adsorption elements (81, 82) is secured sufficiently. In addition, it becomes possible to prevent the drop in CPO in extremely cold climate conditions during the humidification operating mode.

Modified Examples of Second Embodiment

Also in the second embodiment, room air (RA) or conditioned air (CA) may be used as cooling air, as in the first embodiment. When the mixed air (RA+OA) is used as cooling air, the mixing rate of outdoor air (OA) and room air (RA) may be adjusted in the same way as in the first embodiment.

Embodiment 3

An air conditioning apparatus according to a third embodiment of the present invention is provided with a single adsorption element, i.e., an adsorption element (250). And, the air conditioning apparatus of the third embodiment performs an adsorption operation, a cooling operation, and a regeneration operation, and is so constructed as to perform air dehumidification by the adsorption element (250) simultaneously concurrently with regeneration of the adsorbent of the adsorption element (250).

Figure 17:
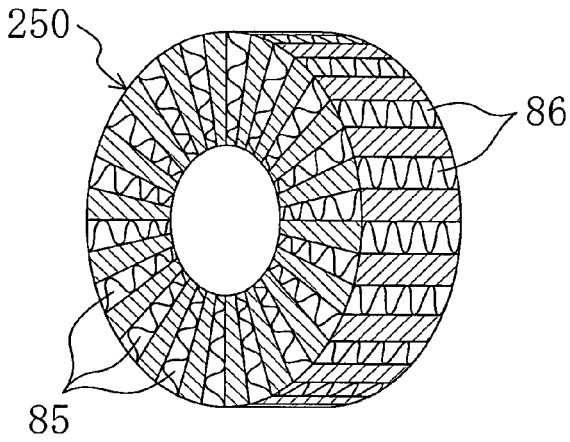
FIG. 17 is a schematic perspective view showing an adsorption element of an air conditioning apparatus according to a third embodiment of the present invention.

As shown in FIG. 17, the adsorption element (250) of the present embodiment is shaped like a doughnut or like a thick cylinder. The adsorption element (250) comprises an alternating arrangement of humidity adjusting side and cooling side passageways (85, 86) divisionally formed in the circumferential direction of the adsorption element (250). Each humidity adjusting side passageway (85) penetrates the adsorption element (250) in the axial direction thereof. In other words, each of the humidity adjusting side passageways (85) opens in front and rear surfaces of the adsorption element (250). Additionally, an internal wall of the humidity adjusting side passageway (85) is coated with an adsorbent. On the other hand, each of the cooling side passageways (86) penetrates the adsorption element (250) in the radial direction thereof. In other words, each cooling side passageway (86) opens in outer and inner peripheral surfaces of the adsorption element (250).

Figure 18:
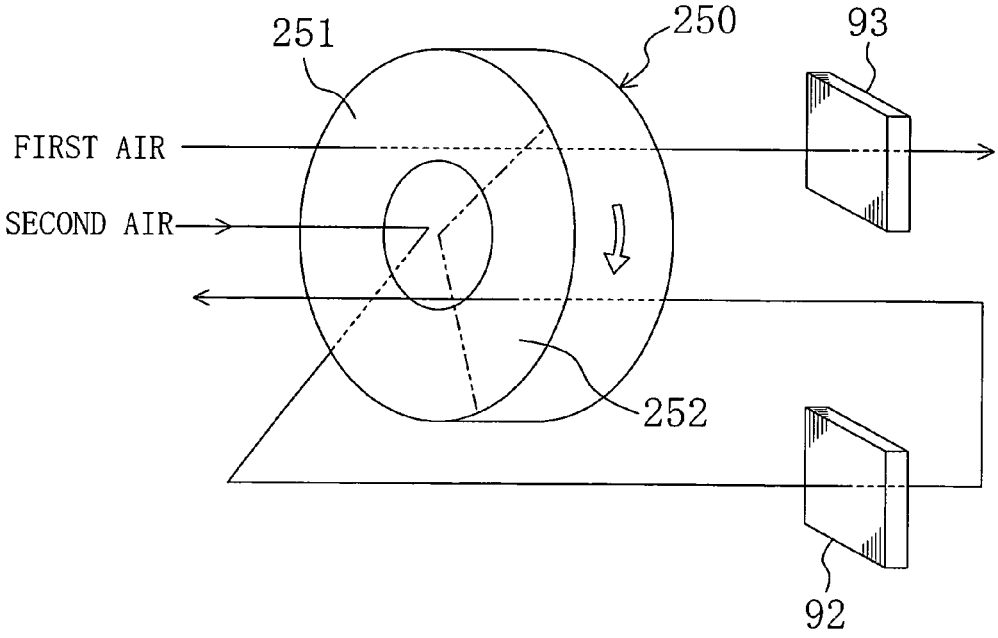
FIG. 18 is a schematic constructional diagram showing a constructional arrangement of the air conditioning apparatus according to the third embodiment.

As shown in FIG. 18, in the air conditioning apparatus, the adsorption element (250) is so disposed as to extend over an adsorption zone (251) and a regeneration zone (252). The adsorption element (250) is driven continuously or intermittently rotationally on an axis passing through the center thereof.

The air conditioning apparatus is provided with a refrigerant circuit. The refrigerant circuit is a closed circuit formed by piping connection of a compressor, a regenerative heat exchanger (92) which operates as a condenser, an expansion valve which operates as an expansion mechanism, and a cooling heat exchanger (93) which operates as an evaporator. The regenerative heat exchanger (92) constitutes a heater. The refrigerant circuit is so formed as to perform a vapor compression refrigeration cycle by circulation of a refrigerant charged. Only the regenerative heat exchanger (92) and the cooling heat exchanger (93) are represented diagrammatically in FIG. 18.

In the air conditioning apparatus, in a section of the adsorption element (250) that is being located in the adsorption zone (251), outdoor air (OA) is introduced, as first air constituting adsorption air, to a humidity adjusting side passageway (85) corresponding to the section, while room air (RA) is introduced, as second air constituting cooling air, into a cooling side passageway (86) corresponding to the section. During that time, the second air is fed to the cooling side passageway (86) from the side of the inner peripheral surface of the adsorption element (250).

In the adsorption zone (251), water vapor contained in the first air (adsorption air) is adsorbed onto the adsorbent in the humidity adjusting side passageway (85) of the adsorption element (250). Heat of adsorption is generated when water vapor is adsorbed onto the adsorbent in the humidity adjusting side passageway (85). The heat of adsorption is collected by the second air (cooling air) flowing through the cooling side passageway (86) of the adsorption element (250).

The first air dehumidified in the adsorption zone (251) passes through the cooling heat exchanger (93). In the cooling heat exchanger (93), the first air is subjected to heat exchange with refrigerant and liberates heat to the refrigerant. Thereafter, the first air dehumidified and cooled is supplied indoors if the dehumidification operating mode is selected. If the humidification operating mode is selected, the first air, which was dehumidified and released heat, is discharged outdoors.

On the other hand, the second air, which has robbed heat of adsorption in the adsorption zone (251), passes through the regenerative heat exchanger (92) as regeneration air. In the regenerative heat exchanger (92), the second air is subjected to heat exchange with refrigerant and absorbs heat of condensation of the refrigerant. The second air heated in the adsorption zone (251) and the regenerative heat exchanger (92) is introduced to a humidity adjusting side passageway (85) of the adsorption element (250) that is being located in the regeneration zone (252). With the rotational movement of the adsorption element (250), the section of the adsorption element (250), which was situated in the adsorption zone (251), moves to the regeneration zone (252).

In the section of the adsorption element (250) situated in the regeneration zone (252), the adsorbent is heated by the second air in a humidity adjusting side passageway (85) corresponding to the section and, as a result, water vapor is desorbed from the adsorbent. In other words, the adsorbent is regenerated. The water vapor desorbed from the adsorbent is given to the second air. Thereafter, the second air is, together with the water vapor desorbed from the absorbent, discharged outdoors if the dehumidification operating mode is selected. On the other hand, if the humidification operating mode is selected, the second air heated and humidified is supplied indoors.

As has been described above, in the adsorption zone (251), an adsorption operation for the adsorption element (250) is carried out while in the regeneration zone (252) a regeneration operation for the adsorption element (250) is carried out. At that time, heat of adsorption, generated in the humidity adjusting side passageway (85) of the adsorption elements (250) is collected by the second air flowing through the cooling side passageway (86). Because of this, the adsorption element (250) is cooled by the second air and the temperature rise of the adsorption element (250) is suppressed.

In the present embodiment, heat of adsorption, generated in the humidity adjusting side passageway (85) of the adsorption element (81, 82) when dehumidifying the first air, is collected by room air (RA) serving as second air, whereby the adsorption element (81, 82) is cooled. As a result of such arrangement, even when the outside temperature is high it becomes possible to suppress the temperature rise of the adsorption element (250) because of use of the room air (RA) lower in temperature than the outdoor air (OA). Besides, the drop in adsorption performance of the adsorption element (81, 82) is suppressed in comparison with the conventional apparatuses, and the amount of moisture adsorbable by the adsorption element (81, 82) is secured sufficiently.

In addition, also in the present embodiment, as second air constituting cooling air, conditioned air (CA) or mixed air (RA+OA) composed of room air (RA) and outdoor air (OA) may be used.

Other Embodiments

It is possible to embody the present invention not only in the foregoing manners but also in other various manners.

In the first and second embodiments the adsorption element is shaped like a rectangular parallelepiped and in the third embodiment the adsorption element is shaped like a disk, which, however, should not in any way be deemed restrictive. For example, the adsorption element may be shaped like a hexagonal prism or other form.

In addition, in each of the foregoing embodiments, the amount of air supply into the room may equal the amount of air discharge to outside the room, or they may not necessarily be the same.

Figure 19A:
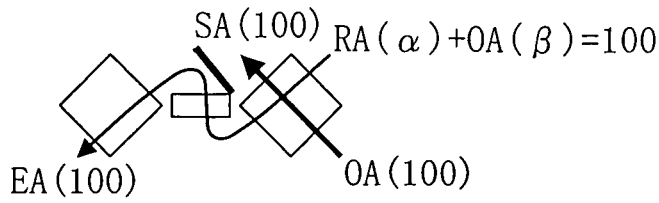
FIG. 19 is a diagram showing air volume control examples in the air conditioning apparatus.

For example, FIG. 19A shows an example of a system in which the ratio of the air volume of outdoor air (OA) as first air to the air volume of mixed air (RA+OA) as second air is 1:1, and the ratio of the air volume of supply air (SA) to the air volume of exhaust air (EA) is 1:1. In other words, if the air volume of outdoor air (OA) as first air is 100, then the air volume of each of mixed air (RA+OA), supply air (SA), and exhaust air (EA) is also 100. In this case, if the outdoor air (OA) is not included in the mixed air (RA+OA), this constitutes a system in which the outdoor air (OA) and the room air (RA) are counterchanged equally in amount. If the outdoor air (OA) is included in the mixed air (RA+OA), this constitutes an air-supply overload system.

Figure 19B:
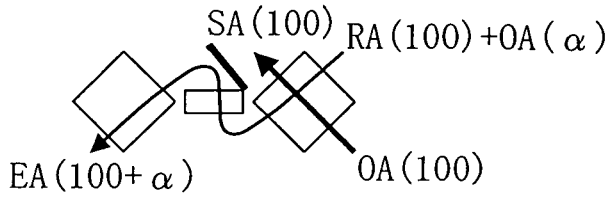

In addition, FIG. 19B shows an example in which the mixed air (RA+OA) is 100+α, the supply air (SA) is 100, and the exhaust air (EA) is 100+α, for the outdoor air (OA) as first air=100. In this case, the outdoor air (OA) and the room air (RA) are counterchanged equally in amount.

Figure 19C:
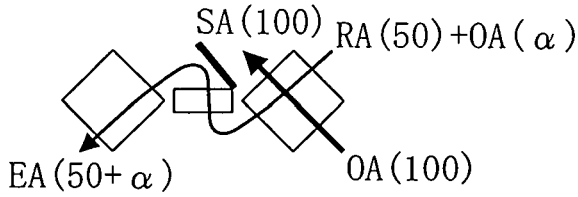

In addition, FIG. 19C shows an example in which the mixed air (RA+OA) is 50+α, the supply air (SA) is 100, and the exhaust air (EA) is 50+α, for the outdoor air (OA) as first air=100. This case constitutes an air-supply overload system.

Figure 19D:
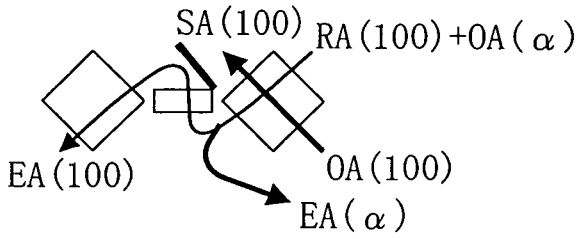
Figure 19E:
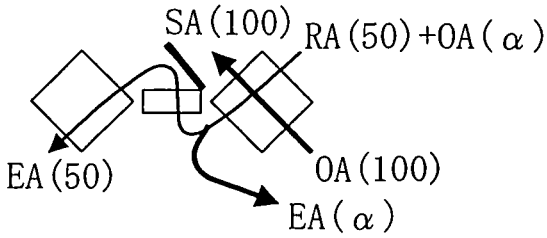

Furthermore, the system configurations, shown in FIGS. 19B and 19C may be modified so that part of the second air is discharged as shown in FIGS. 19D and 19E. Such arrangement makes it possible to control the volume of regeneration air.

Although each of the examples of FIG. 19 illustrates air volume control during the dehumidification operating mode, it is possible to perform air volume control during the humidification operating mode.

Industrial Applicability

As has been described above, the present invention is useful for air conditioning apparatuses of the desiccant type.

What is claimed is:

1. An air conditioning apparatus, comprising:

a first adsorption element having a humidity adjusting side passageway configured to adsorb moisture by passage of adsorption air and desorb moisture by passage of regeneration air; and a cooling side passageway configured and arranged to receive room air as at least part of cooling air for absorption of heat of adsorption generated during said adsorption in said humidity adjusting side passageway, said air conditioning apparatus being configured and arranged to supply air having a humidity level which has been adjusted in said humidity adjusting side passageway of said first adsorption element to an indoor space.

2. An air conditioning apparatus, comprising:

a first adsorption element having a humidity adjusting side passageway configured to adsorb moisture by passage of adsorption air and desorb moisture by passage of regeneration air; and a cooling side passageway configured and arranged to receive conditioned air as at least part of cooling air for absorption of heat of adsorption generated during said adsorption in said humidity adjusting side passageway, said air conditioning apparatus being configured and arranged to supply air having a humidity level which has been adjusted in said humidity adjusting side passageway of said first adsorption element to an indoor space.

3. The air conditioning apparatus as set forth in claim 1, further comprising a second adsorption element, said air conditioning apparatus is configured to perform a first operation which carries out said adsorption by forcing adsorption air to flow through said humidity adjusting side passageway of said first adsorption element and simultaneously carries out cooling by forcing said cooling air to flow through said cooling side passageway of said first adsorption element and, in addition, carries out regeneration by forcing regeneration air to flow through a humidity adjusting side passageway of said second adsorption element, said air conditioning apparatus is configured to perform a second operation which carries out adsorption by forcing adsorption air to flow through said humidity adjusting side passageway of said second adsorption element and simultaneously carries out cooling by forcing cooling air to flow through a cooling side passageway of said second adsorption element and, in addition, carries out regeneration by forcing regeneration air to flow through said humidity adjusting side passageway of said first adsorption element, and said first and second operations are executed in alternation.

4. The air conditioning apparatus as set forth in claim 3, further comprising a switching mechanism configured to switch flow channels of adsorption air, cooling air, and regeneration air, and said air conditioning apparatus is configured to switch between said first operation and said second operation by operation of said switching mechanism and by forcing said first and second adsorption elements to rotate through a predetermined angle.

5. The air conditioning apparatus as set forth in claim 3, further comprising a switching mechanism configured to switch flow channels of adsorption air, cooling air, and regeneration air, and said air conditioning apparatus is configured to switch between said first operation and said second operation by executing operation of said switching mechanism with said first and second adsorption elements fixed in position.

6. The air conditioning apparatus as set forth in claim 1, wherein said first adsorption element is shaped like a circular disk and has a plurality of said humidity adjusting side passageways that pass completely through said first adsorption element in a thickness-wise direction thereof and a plurality of said cooling side passageways that pass completely through said first adsorption element in a radial direction thereof, said first adsorption element is rotated around its central axis, and said air conditioning apparatus is configured to carry out adsorption by introducing adsorption air into one of said humidity adjusting side passageways which is formed in a portion of said first adsorption element and simultaneously carry out cooling by forcing said cooling air to flow through one of said cooling side passageways in association with said one of said humidity adjusting side pass ageways and, in addition, carry out regeneration by introducing regeneration air into another one of said humidity adjusting side passageways that is formed in another portion of said first adsorption element.

7. The air conditioning apparatus as set forth in claim 3, wherein said air conditioning apparatus is configured to heat said cooling air of said first and second operations to result in said regeneration air of said first and second operations, respectively.

8. The air conditioning apparatus as set forth in claim 6, wherein said air conditioning apparatus is configured to heat said cooling air to result in said regeneration air.

9. An air conditioning apparatus, comprising:

a first adsorption element having a humidity adjusting side passageway configured to adsorb moisture by passage of adsorption air and desorb moisture by passage of regeneration air; and a cooling side passageway configured and arranged to receive a combination of room air and outdoor air as at least part of cooling air for absorption of heat of adsorption generated during said adsorption in said humidity adjusting side passageway, said air conditioning apparatus being configured and arranged to supply air having a humidity level which has been adjusted in said humidity adjusting side passageway of said first adsorption element to an indoor space.

10. The air conditioning apparatus as set forth in claim 9, further comprising a second adsorption element, said air conditioning apparatus is configured to perform a first operation which carries out said adsorption by forcing adsorption air to flow through said humidity adjusting side passageway of said first adsorption element and simultaneously carries out cooling by forcing said cooling air to flow through said cooling side passageway of said first adsorption element and, in addition, carries out regeneration by forcing regeneration air to flow through a humidity adjusting side passageway of said second adsorption element, said air conditioning apparatus is configured to perform a second operation which carries out adsorption by forcing adsorption air to flow through said humidity adjusting side passageway of said second adsorption element and simultaneously carries out cooling by forcing cooling air to flow through a cooling side passageway of said second adsorption element and, in addition, carries out regeneration by forcing regeneration air to flow through said humidity adjusting side passageway of said first adsorption element, and said first and second operations are executed in alternation.

11. The air conditioning apparatus as set forth in claim 10, further comprising a switching mechanism configured to switch flow channels of adsorption air, cooling air, and regeneration air, and said air conditioning apparatus is configured to switch between said first operation and said second operation by operation of said switching mechanism and by forcing said first and second adsorption elements to rotate through a predetermined angle.

12. The air conditioning apparatus as set forth in claim 10, further comprising a switching mechanism configured to switch flow channels of adsorption air, cooling air, and regeneration air, and said air conditioning apparatus is configured to switch between said first operation and said second operation by executing operation of said switching mechanism with said first and second adsorption elements fixed in position.

13. The air conditioning apparatus as set forth in claim 9, wherein said first adsorption element is shaped like a circular disk and has a plurality of said humidity adjusting side passageways that pass completely through said adsorption element in a thickness-wise direction thereof and a plurality of said cooling side passageways that pass completely through said adsorption element in a radial direction thereof, said first adsorption element is rotated around its central axis, and said air conditioning apparatus is configured to carry out adsorption by introducing adsorption air into one of said humidity adjusting side passageways which is formed in a portion of said first adsorption element and simultaneously carry out cooling by forcing said cooling air to flow through one of said cooling side passageways in association with said one of said humidity adjusting side passageways and, in addition, carry out regeneration by introducing regeneration air into another one of said humidity adjusting side passageways that is formed in another portion of said first adsorption element.

14. The air conditioning apparatus as set forth in claim 9, wherein said cooling side passageway is configured and arranged to receive said combination of room air and outdoor air as a mixture that results from mixing said room air and said outdoor air at a predetermined mixing rate according to a temperature of said room air and a temperature of said outdoor air.

15. The air conditioning apparatus as set forth in claim 9, wherein said cooling side passageway is configured and arranged to receive said combination of room air and outdoor air as a mixture that results from mixing said room air and said outdoor air at a predetermined mixing rate according to a temperature of said room air and a temperature of indoor supply air.

16. The air conditioning apparatus as set forth in claim 9, wherein said cooling side passageway is configured and arranged to receive said combination of room air and outdoor air as a mixture that results from mixing said room air and said outdoor air at a predetermined mixing rate according to a humidity of said room air and a humidity of said outdoor air.

17. The air conditioning apparatus as set forth in claim 10, wherein said air conditioning apparatus is configured to heat said cooling air of said first and second operations to result in said regeneration air of said first and second operations, respectively.

18. The air conditioning apparatus as set forth in claim 2, further comprising a second adsorption element, said air conditioning apparatus is configured to perform a first operation which carries out said adsorption by forcing adsorption air to flow through said humidity adjusting side passageway of said first adsorption element and simultaneously carries out cooling by forcing said cooling air to flow through said cooling side passageway of said first adsorption element and, in addition, carries out regeneration by forcing regeneration air to flow through a humidity adjusting side passageway of said second adsorption element, said air conditioning apparatus is configured to perform a second operation which carries out adsorption by forcing adsorption air to flow through said humidity adjusting side passageway of said second adsorption element and simultaneously carries out cooling by forcing cooling air to flow through a cooling side passageway of said second adsorption element and, in addition, carries out regeneration by forcing regeneration air to flow through said humidity adjusting side passageway of said first adsorption element, and said first and second operations are executed in alternation.

19. The air conditioning apparatus as set forth in claim 18, further comprising a switching mechanism configured to switch flow channels of adsorption air, cooling air,and regeneration air, and said air conditioning apparatus is configured to switch between said first operation and said second operation by operation of said switching mechanism and by forcing said first and second adsorption elements to rotate through a predetermined angle.

20. The air conditioning apparatus as set forth in claim 18, further comprising a switching mechanism configured to switch flow channels of adsorption air, cooling air, and regeneration air, and said air conditioning apparatus is configured to switch between said first operation and said second operation by executing operation of said switching mechanism with said first and second adsorption elements fixed in position.

* * * * *